United States Patent [19]

Mihara

[11] Patent Number: 4,905,749

[45] Date of Patent: Mar. 6, 1990

[54] METHOD OF DRIVING AND CONTROLLING ROTARY TABLE IN DIE CASTING MACHINE

[75] Inventor: Takeshi Mihara, Ube, Japan

[73] Assignee: Ube Industries, Ltd., Yamaguchi, Japan

[21] Appl. No.: 391,633

[22] Filed: Aug. 7, 1989

Related U.S. Application Data

[63] Continuation of Ser. No. 235,559, Aug. 24, 1988, abandoned.

[30] Foreign Application Priority Data

| | | | |
|---|---|---|---|
| Aug. 28, 1987 | [JP] | Japan | 62-214910 |
| Jun. 30, 1988 | [JP] | Japan | 63-163073 |
| Jul. 4, 1988 | [JP] | Japan | 63-164967 |

[51] Int. Cl.[4] ..... B22D 5/02; B22D 46/00

[52] U.S. Cl. ..... 164/4.1; 164/130; 164/326; 164/327; 164/154

[58] Field of Search ..... 164/4.1, 150, 154, 157, 164/323, 324, 325, 326, 327, 328, 130

[56] References Cited

U.S. PATENT DOCUMENTS

| | | | |
|---|---|---|---|
| 3,703,921 | 11/1972 | Hunter | 164/130 |
| 3,866,666 | 2/1975 | Wunder | 164/327 |
| 4,754,801 | 7/1988 | Ueno et al. | 164/327 |

FOREIGN PATENT DOCUMENTS

| | | | |
|---|---|---|---|
| 2657984 | 6/1978 | Fed. Rep. of Germany | 164/325 |

*Primary Examiner*—Richard K. Seidel

*Attorney, Agent, or Firm*—Charles E. Brown; Charles A. Brown

[57] ABSTRACT

This invention relates to a die casting machine in which a plurality of mold opening and closing units each having a pair of metal molds are positioned in suitable positions in the outer periphery of a rotary table and the rotary table is intermittently rotated so as to stop the mold opening and closing units in positions in alignment with associated operation stations. In the die casting machine, a rotary detection rotary shaft is provided for following the rotation of the rotary table, while the rotary shaft is making one complete rotation, a rotational angle detector produces outputs, the values of which increase continuously corresponding to angular positions of the rotary table for detecting rotational angles of the table whereby the table is driven and controlled and the angular position of the rotary table is detected using the rotational angle of the rotary detection shaft which is rotated through a gear provided on the drive shaft of a hydraulic motor driving the rotary table whereby the mold opening and closing units are mounted on the table error in measurement caused by distortion of the table when can be minimized to thereby detect the angular position of the table with high precision and precisely and easily brake and stop the table.

6 Claims, 23 Drawing Sheets

METHOD OF DRIVING AND CONTROLLING ROTARY TABLE IN DIE CASTING MACHINE

This application is a continuation of application Ser. No. 235,550, filed 8/24/88, now abandoned.

BACKGROUND OF THE INVENTION

This invention relates to a die casting machine in which a plurality of mold opening and closing units holding metal molds are rotated by a rotary table and a casting operation is performed in successive steps in a plurality of operation stations disposed in an equally spaced relationship on the locus of the rotational movement of the units.

The applicant has previously developed a rotary die casting machine with the object of substantially enhancing its productivity (Japanese patent application Sho 61(1986)-195766). The die casting machine is so designed that mold opening and closing units for holding metal molds are mounted in positions in a spaced relationship in the outer periphery of a rotary table dividing the periphery of the table and as the rotary table rotates, the mold opening and closing units are stopped in positions in alignment with a plurality of operation stations disposed on the locus of the mold opening and closing units to perform different operations in succession.

The previously proposed die casting machine will be described referring to FIG. 1. The die casting machine 1 comprises a rotary table 14 and a first station 2, a second station 3 and a third station 4 disposed about the periphery of the rotary table 14. The center lines of the first station 2, the second station 3 and the third station 4 are disposed at an angle of 120° to each other as shown by L1, L2 and L3, respectively. As more clearly shown in FIG. 2, a hollow vertical shaft 13 in the shape of an inverted funnel is provided on the table support portion 5*a* of a base platen and a tie bar 6 is secured within the shaft 13 in co-axial relationship to the shaft. The rotary table 14 is rotatably supported on the hollow shaft 13 by means of upper and lower ball bearings 15, 16. As more clearly shown in FIG. 3, the rotary table 14 has a center frame 17 in the shape of a regular triangle box and is provided with three mold opening and closing unit holding portions 18A, 18B and 18C each corresponding to each side of the triangle. The table 14 further has sector-shaped support boards 19A, 19B and 19C disposed between the adjacent mold opening and closing unit holding portions 18A, 18B and 18C, respectively. As more clearly shown in FIG. 4, a gear 20 is secured to the rotary table 14 and meshes a pinion 100 connected to the shaft of a motor 101 which is in turn secured to the table support portion 5*a* of the base platen 5. The motor 101 is driven by control means (not shown) to intermittently rotate the rotary table 14 by one third of its complete rotation at one time. When the rotary table 14 is to be stopped, a knock pin 102 having a tapered convex at the upper end is pushed up by a cylinder mechanism 103 provided on the base platen 5 so as to insert the knock pin 102 into a selected one of the tapered recesses 104*a*–104*c* of the same shape formed in the undersurface of the center frame 17 of the rotary table 14 whereby each mold opening and closing unit 29 can be stopped in proper alignment with the associated operation station.

The first station 2 comprises the base platen 5 integrally including the table support portion 5*a* of circular shape as seen in plane and a injection portion 5*b* of equilateral triangle shape as seen in plane. The base platen 5 is secured to a basement on the floor (see FIG. 2). And the tie bars 6, 7 are provided in upright disposition at the center of the table support portion 5*a* and at the opposite ends of the base of the equilateral triangle of the injection portion 5*b*, respectively. The upper ends of the tie bars 6 and 7 are inserted in tie bar holes (not shown) in a cylinder platen 8 of equilateral triangle and firmly held there by means of nuts 9. The first station 2 has the above-mentioned framework and is further provided with mold fastening means 10, injection means 11 and automatic molten metal supply means 12.

The second station 3 comprises a push frame 21 and a push cylinder frame 24. The push frame 21 has an equilateral triangle shape as seen in plane and is fixedly secured to the above-mentioned cylinder platen 8. The push cylinder frame 24 is fixedly secured to the table support portion 5*a* of the base platen 5 throuth a bracket 22. A tie bar 23 connects between the push cylinder frame 24 and push frame 21 (see FIG. 6). The second station 3 has the above-mentioned framework and is further provided with metal mold preparing means 25, product take-out means 26, a push cylinder 27 and a discharge cylinder 28 as more clearly shown in FIGS. 1 and 2. The metal mold preparing means 25 is adapted to present the mold opening and closing units 29 to mold opening and closing unit holding portions 18A, 18B at the time of start of the casting operation and metal mold replacement and take the unit out of the mold opening and closing unit holding portions 18A (18B, 18C). The metal mold preparing means 25 comprises a frame 30 secured to the floor and the frame 30 extends from below the mold opening and closing unit holding portion 18A (18B, 18C) which stops in the second station 3 towards the center line L2 of the second station 3. Further, a plurality of rollers 32 are disposed on the opposite sides of the upper surface of the above-mentioned frame 30 to be selectively rotated in forward and reverse directions from the motor 31 through a belt or chain (not shown).

Each mold opening and closing unit 29 holds a fixed metal mold 33 and a movable metal mold 34 and is adapted to move the movable metal mold to and away from the fixed metal mold.

Further, the third station 4 is not provided with the frame-work as provided in the first or second station 2 or 3, but comprises spray means 35 and insert means (not shown). The spray means 35 is adapted to clean the metal molds 33, 34 of the mold opening and closing unit 29 and spray release agent into the molds when the unit is newly installed on the rotary table 14 and after the product has been removed from such metal molds. The spray means 35 has an arm 38 and is supported by a frame 36. The arm 38 is advanced and reetracted by an oil pressure cylinder 37 and has a spray head 39 mounted at the leading end of the arm 38. In order to perform cleaning on the metal molds 33, 34, the arm 38 is advanced to position the spray head 39 between the metal mold 33, 34 whereupon air and release agent are spouted from the spray head 39 whereby the release agent is applied to the metal molds 33, 34. Reference numeral 40 denotes conventional core inserting means adapted to position a core (not shown) between the metal molds 33, 34. After the cleaning and other operations in the third operation station, the mold opening and closing unit 29 loosely closes the molds 33, 34 and is moved to the first operation station 2 as the rotary table 14 rotates by one third of its complete rotation and the above-mentioned mold closing and molten metal injection operation are performed in the first station 2.

The mold closing means 10 in the first station 2 comprises a cylinder 41 integral with the cylinder frame 8 and a main ram 43. The main ram 43 is received in the above-mentioned cylinder 41 and moves upward and downward under the pressure of oil introduced into the cylinder 41 throuth a port 42 formed in the cylinder 41. The main ram 43 has a moving platen 44 secured thereto. A pair of pull back cylinders 45 are secured to the upper surface of the cylinder platen 8 on the opposite sides of the above-mentioned cylinder 41 and the piston rod 48 of the pull back cylinder 45 extends through the cylinder platen 8 and is secured at the leading end thereof to the moving platen 44. With the above-mentioned arrangement of the components of the fastening means 10, when the main ram 43 is moved downward under the pressure of oil introduced into the cylinder 41, the metal molds 33, 34 loosely fastened by the mold opening and closing unit 29 are firmly fastened together under oil pressure. When oil is introduced into the pull back cylinder 43 after the removal of oil pressure, the moving platen 44 moves upward to thereby release the metal molds 33, 34 from the fastening force.

The injection means 11 comprises an injection cylinder 48 supported on tie bars (not shown) and a frame 47 depending from the base platen 5. The piston rod 49 of the injection cylinder 48 moves upward under the pressure of oil introduced in the cylinder and has a plunger 50 connected thereto by means of a coupling 51. The plunger 50 is received in an injection sleeve 54 which in turn moves upward and downward and is supported on a block 53 movable upward and downward by a ram 52. The injection sleeve 54 movable upwardly together with the block 53 by the ram 52 is received in a stationary sleeve (not shown) on the fixed metal mold 33 and the plunger 50 within the injection sleeve 54 moves upward by an injection cylinder 48 whereby molten metal within the injection sleeve 54 is injected into the cavity defined between the metal molds 33, 34.

The above-mentioned injection cylinder 48 can tilt to the position shown by the chain line L4 in FIG. 2 by means of tilting means (not shown). The automatic molten metal supply means 12 comprises a frame 55 provided on the base platen 5 extending uprightly therefrom and a main body 57 supported on the frame 55 through a four-joint link 56. Disposed below the main body 57 is a melting furnace 59 which rests on the floor. The above-mentioned main body 57 is provided at the leading end with a ladle 60 which is adapted to be inserted into the molten metal in the above-mentioned melting furnace 59 when a servo-motor 58 or the like drives to draw up the molten metal. The main body 57 moves to a position co-inciding with the chain line L4 by the 4-joint link 56 to supply the metal to the interior of the injection sleeve 54.

As the molten metal within the cavity is cooled to solidify, the pressurized oil is exhausted from the cylinder 41 through the port 42 and at the same time oil under pressure is introduced into the pull back cylinder 45 to raise the moving platen 44 whereupon the platen is released from the pressurizing action.

After the mold fastening under pressure, injection and pressure releasing operations in the first station have been completed, the mold opening and closing unit 29 holding the metal mold in its loose fastening condition is rotated to the second station 3 as the rotary table 14 rotates by one third of its complete rotation and stops in the second station where the metal molds are opened to take the product out of the molds.

The push cylinder 27 in the second station 3 comprises a piston rod (not shown) adapted to advance into the cavity defined between the metal molds 33, 34 under oil pressure. The product formed in the cavity is held on the movable metal mold 34 and the metal molds are opened. The discharge cylinder 28 in the second station 3 comprises a push pin (not shown) at the leading end of the piston rod which protrudes into the cavity in the movable metal molds 33, 34 and as the piston rod moves downwardly under the pressure of oil, the product is pushed out of the cavity.

The above-mentioned product removing means 26 receives the product pushed out of the cylinder and discharges the product onto the floor after cooling thereof. The product removing means 26 comprises a tray 62 and a puller 64 and is driven by an oil pressure cylinder 61. The tray 62 has a horseshoe shape. The tray 62 advances and retracts between the position shown and the central positions of the metal molds 33, 34. And the puller 64 advances and retracts in a direction at right angles to the tray 62. When the tray 62 which has received the product pushed out of the mold 34 in the advanced position retracts to the illustrated position, the puller 64 which is waiting in a position beyond the limit of advancement of the tray 62 retracts to pull the product from the tray 62 onto a cage 65. Although not shown, the cage 65 is provided with a link mechanism. When the link mechanism is moved by drive means (not shown), the cage 65 holding the product reciprocally moves between the position shown in FIG. 2 and a cooling tank (not shown) which cools the product in cold water contained therein. The cooled product slides down a chute (not shown) onto the floor. After the product has been discharged onto the floor, the mold opening and closing unit 29 moves to the third station 4 with the molds left open.

The above description is in connection with the step sequence when the single mold opening and closing unit 29 is provided in the rotary die casting machine. In the rotary die casting machine, each time the other mold opening and closing unit holding portions 18B, 18C stop in the second station 3, two additional mold opening and closing units 29 are attached to the mold opening and closing unit holding portions 18B, 18C whereby the three mold opening and closing units 29 are now mounted on the mold opening and closing unit holding portions 18A, 18B, 18C and the above-mentioned operations are then performed in the station 2, 3, 4 to perform the usual casting operation.

The operation for intermittently rotating and stopping the rotary table will be described hereinafter.

As shown in FIG. 3, the rotary table 14 rotates in the direction of the arrow and disposed below the rotary table 14 is a gear 20 having a cam or cams 120 integral therewith for driving the table as shown in FIGS. 4 and 5. The number of the cams 120 is equal to the number of the operation stations and accordingly, to the number of the stop positions. In the example illustrated, since the number of the stop positions is three, three cams 120*a*, 120*b*, 120*c* are disposed in a circumferentially equally spaced relationship. The front surface 131 of each cam 120 is formed with a plurality of recesses 133 as shown more clearly in FIG. 7. The recess 133 at the leading end of the cam 120 in the rotational direction of the same is wider than the other recesses.

Further, proximity switches 125, 126 are mounted on a base 123 in a vertically spaced relationship for detecting the associated cam 120 and the switch base is fixedly secured to a member such as the fixed base platen 5, for example (see FIG. 6). The upper proximity switch 125 is positioned in a level for detecting the front end face 131 of the cam 120 secured to the above-mentioned gear 20 by means of a bolt 121 and the lower proximity switch 126 is secured to a base 123 in a level for detecting the plurality of recesses 133 formed in the cam 120.

Thus, as the rotary table 14 rotates, when the cam 120 advances to approach the fixed upper and lower cam detection proximity switches 125, 126 in the direction shown by the arrow in FIG. 7 rightwards in the figure, the upper cam detection proximity switch 125 detects the edge 132 at the leading end face 131 of the cam 120. At this time, the fixed lower proximity switch 126 positioned below the upper proximity switch 125 is positioned on the first or leading recess 133 in the cam 120 and is still not detecting the cam edge 132. As the cam 120 continues to advance as shown by S1 in FIG. 8, since the leading end face 131 passes in a position very close to the cam detection proximity switch 125, the cam detection proximity switch 125 continues to detect the cam 120. On the other hand, as the lower detection proximity switch 126 is approaching the first edge 141 of the rearmost recess 133 in the cam 120, the switch 126 detects the cam 120 by means of the land 134 adjacent to the first edge 141 and then passes the next recess 133 without detecting the cam 120 and then again detects the cam 120 as the second edge 142 approaches the switch 126. In this way, the lower detection proximity switch 126 can repeatedly detect the cam 120 each time one land 134 of the cam 120 approaches the switch. That is, the upper cam detection proximity switch 125 produces a signal S1 confirming the presence of the cam 120 (120*a*–120*c*) and the lower recess detection proximity switch 126 produces a signal S2 by sensing the recesses 133 and convexes or lands 134 provided on each cam with equally spaced pitch P. By counting the number of pulse signals by a counter, the angular position of the rotary table 14 can be precisely known whereby the rotary table 14 can be stopped in any predetermined position at a predetermined rate of deceleration.

That is, each cam 120 and the recess detection proximity switch 126 form means for detecting the angular position of the rotary table 14 and the cam is unevend to form a plurality of recesses 133 and the switch 126 produces a signal having a plurality of pulses by detecting the recesses and lands 133, 134 in succession (FIG. 8). As more clearly shown in FIG. 10, the pulse signal S2 is fed to a counter 135 which counts the pulse signals S2 to operate a controller 136 which in turn controls and operates a flow rate control valve 140 to thereby decelerate the rotational speed of the rotary table 140. For example, the pulse signals S2 produced from the position detector for decelerating the rotary table 14 per pulse decelerates the rotary table 14 from the high speed V1 per pulse and the rotary table 14 is stopped when the recess detection proximity switch 126 detects a predetermined recess 133 out of all the recesses 133 formed in the cam 120 (see FIG. 9).

Thus, the rotary table 14 can be precisely stopped in a predetermined position referring to the recesses 133 formed in the cam 120.

FIG. 8 respectively shows the output signal S1 from the cam detection proximity switch 125 and the output signal S2 from the recess detection proximity switch 126 when the cam 120 is rotated at a constant rotational speed.

The cam detection proximity switch 125 outputs a signal sooner than the recess detection proximity switch 126 by a time t1 during which time the rotary table 14 moves by the distance covering the length L1 of the first recess 123 at the leading end portion of the cam 120 and terminates the production of signals later than the recess detection proximity switch 126 by a time t2 during which the rotary table 14 moves by the distance covering the length L2 of the portion of the cam following the last recess 133.

Thus, by the utilization of the rise of detection signals from the cam detection proximity switch 125, the counter 135 counting pulse signals of the above-mentioned recess detection proximity switch 126 can be easily reset. The position detector can be easily designed so that only during the time period the cam detection proximity switch 125 is detecting the cam 120, does the recess detection proximity switch 126 count the recesses and/or lands 134. If the counter 135 is always reset before the recesses 133 are counted by the recess detecting proximity switch 126, even if the counter 135 counts erroneously due to noise produced during the time period the counter 135 is not counting, it is made possible that the counter 135 is not subjected to adverse effects when the counter 135 in fact counts whereby deceleration and stopping of the rotary table 14 can be more positively controlled.

Further, the hydraulic pressure circuit shown in FIG. 10 is divided into a direction switching valve 139 and a flow rate control valve 40 which controls displacement flow rate from the hydraulic motor 101. The flow rate control valve 140 is the subject of the co-pending Laid-Open Japanese Patent application Publication No. 57-6863 in the name of the present application. The flow rate control valve 40 rotates a ball screw 142 by means of a pulse motor 141 as shown in FIG. 11 and the ball screw 142 moves a nut shaft 143 back and forth so that the nut shaft 143 directly drives a valve spool 144. As described hereinabove, output signals in pulse form to be detected by the recess detection proximity switch 126 are input to the counter 135 and the count value of the counter 135 directly controls the opening and closing speed of the valve spool 144 of the flow rate control valve 140 so that the operation of the flow rate control valve 140 decreases the opening of the flow rate control valve 140 in succession each time the recess detection proximity switch 126 detects the recesses 133 formed in the cam 120 fixedly secured to the rotary table 14.

A brake circuit 114 is constituted by a check valve 115 and a relief valve 118 and the brake circuit 114 is a conventional pressure adjusting circuit adapted to prevent occurrence of abnormal pressure in the hydraulic circuit.

In controlling the deceleration and stopping of the rotary table 14 by controlling the rotational speed of the rotary table 14 while detecting the recesses in the cam 120 by the recess detection proximity switch 126, in order to precisely stop the rotary table 14 in a predetermined stop position, it is necessary to reduce the pitch P of the recesses and lands. In order to precisely detect the recesses and lands of a cam having a small pitch P of the recesses and land by the recess detection proximity switch 126 it is necessary that the recess detection proximity switch 126 is provided as near as possible to the surface of the cam 120.

However, in a large size apparatus such as the rotary die casting machine of the instant invention in which the rotary table 14 has an outer diameter of about 6 m and in which a plurality of mold opening and closing units 29 of several tons are employed, as shown in FIG. 6, the allowable minimum clearance l between the cam 120 and proximity switch 126 is 1 mm. Further, the allowable minimum P of the recesses and lands is about 10 mm (the width of the lands 134 and recesses 133 is about 5 mm).

The reason why the allowable minimum clearance l between the cam 120 and recess detection proximity switch 128 is defined as being 1 mm is that the diameter of the bearings supporting the rotary table 14 is 1 m and the size tolerance of the bearings supporting the table is about 0.1 mm to 0.3 mm. Furthermore, when the mold opening and closing units 29 each having a weight of about 30 to 50 tons are mounted onto and demounted from the rotary table 14, distortion of the order of about 0.1 to 0.2 mm occurs on the rotary table 14. The minimum limit of the pitch P is because the easily available recess determination proximity switch having a limited discrimination capacity can not discriminate between the recess 133 and lands 134 when the clearance between the recesses and lands is below about 10 mm.

Taking errors in mounting, adjustment and maintenance of the position detector into consideration, the practical limit of the pitch P is about 15 mm at which limit fine detection of the rotary table becomes difficult and enhancement of precision in table position detecting cannot be attained.

In addition, there is the drawback that when the distance between the cam 120 and proximity switch 126 increases due to occurence of distortion of the rotary table 14, the timing for detecting a selected recess 134 and producing a signal by the recess detection proximity switch 126 delays to thereby make it difficult to precisely detect the angular position of the rotary table 14.

Further, the final positioning of the rotary table 14 is performed by inserting the knock pin 102 into a selected one of the tapered recesses **104*a*–104*c* formed in the undersurface of the table 14 if the rotary table 14 has a diameter of several m, because of error in forming the tapered recesses 104*a*–104*c*, even when the operation stations are disposed in an equally spaced relationship to thereby control the braking and stopping of the rotary table 14, when the knock pin is inserted into any one of the tapered recesses 104*a*–104*c*, there is the drawback that tremor occurs in the rotary table 14 due to a deviation in position of the tapered recesses 104*a*–104*c*** resulting in the occurrence of impact.

SUMMARY OF THE INVENTION

One object of the present invention is to first precisely detect the angular position of the rotational table in operating the above-mentioned rotary die casting machine. Further, the present invention resides in that the rotary table is decelerated to stop in a proper position based on the detection of the angular position of the rotary table.

A further object of the present invention is to control the rotation of the rotary table by decelerating and accelerating the table. A yet further object of the present invention is to shorten the time period of deceleration to thereaby rotate and stop the rotary table quickly.

For the objects, in a rotary die casting machine wherein a plurality of mold opening and closing units each holding a pair of metal molds are disposed in the outer periphery of the rotary shaft in suitably spaced relationship and the rotary table is intermittently rotated to bring the mold opening and closing units into in alignment with operation stations whereupon the table is stopped so that different operations are simultaneously performed in the stations, respectively, a rotary detection shaft is provided to rotate following the rotation of the rotary table, a rotational angle detector for detecting rotational angles of the rotary table while the rotary shaft is making one complete rotation is provided to continuously produce output signals the values of which increase gradually to thereby drive and control the rotary table, the operation stations are equally spaced and one complete rotation of the rotary shaft corresponds to the angular distance by which the rotary table moves. Further, as the values of output signals from the rotational angle detector increase, the rotary table is decelerated to stop when the values of output signals from the rotational angle detector increase to a predetermined value. In this manner, according to the present invention, the rotary shaft is provided to rotate following the rotation of the rotary table and the rotational angle detector produces output signals the values of which continuously increase in proportion to the rotational angle of the rotary shaft. Thus, the amounts of rotation of the rotary table can be detected in values increasing in succession whereby the rotational angles representing amounts of rotation of the rotary table can be positively determined and the table can be easily breaked and stopped with enhanced precision. As the rotary table rotates, the value of the output of the rotational angle detector linearly increases and the angular position of the rotary table can be precisely detected based on the values of the output signals whereby the rotary table can be easily driven and controlled.

Further, when the operations are disposed in equally angular spaced relationships and one complete rotation of the rotary shaft corresponds to the angular distance by which the rotary table moves between adjacent operation stations, the rotary table can be rotated so that the valve opening and closing units can be moved between the adjacent operation stations by single operation and the program for driving and decelerating the rotary table can be simplified whereby the rotary table can be more easily driven and controlled.

When the rotary table is decelerated and stopped while the values of outputs from the rotational angle detector the operation procedure for decelerating and stopping the rotary table can be made more easier.

According to the present invention, the rotational angle detector detects the angular position of the rotary table when the table is held in a fixed position by the knock pin. The detection value of the detector is employed as a reference for the next stop position of the rotary table, the position at which the rotary table is decelerated is calculated based on the reference stop position to obtain a reference set value Sm. The value of an output signal in the rotation of the rotary table and the reference set value Sm are compared with each other and when the signal values coincide with each other, the rotary table is decelerated.

In the deceleration and controlling method of the invention described hereinabove, since the stop position of the rotary table held by the knock pin is detected and the detected value is memorized in memory means, even when tapered recesses which deviate from a proper 120° angular spaced relationship are erroneously formed, the rotary table can be stopped accomodating the deviation.

Further, since the number of the mold opening and closing units provided on the rotary table is detected, programs for controlling the acceleration and deceleration of the rotary table depending upon the number of the mold opening and closing units can also be switched.

Since the drive controlling method described above performs a controlling function based on the number of the mold opening and closing units provided, the mold opening and closing units can be decelerated to stop in proper stop positions in a short period of time.

The above and other objects and attendant advantages of the present invention will be more readily apparent to those skilled in the art from a reading of the following detailed description in conjunction with the accompanying drawings which show preferred embodiments of the invention for illustration purpose only, but not for limiting the scope of the same in any way.

PREFERRED EMBODIMENTS OF THE INVENTION

Figure 14:
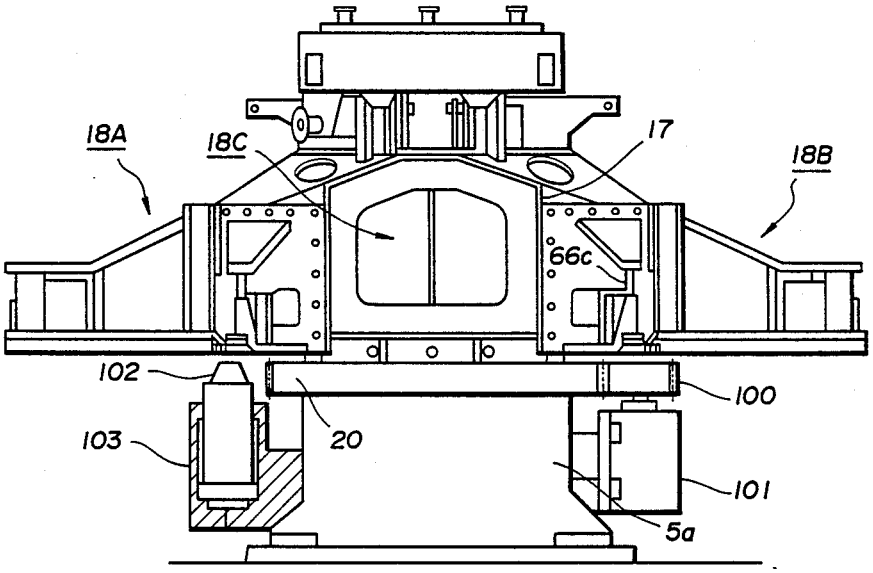
FIG. 14 is a side elevational view of the rotary table in the die casting machine of the present invention.
Figure 16:
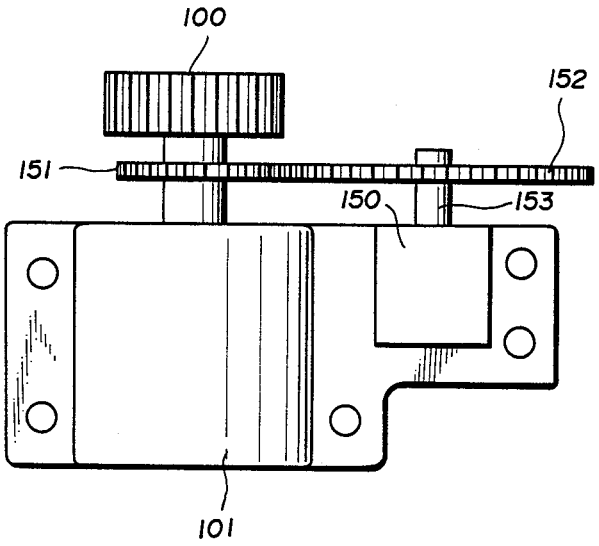
FIG. 16 is a view showing the mounting of the rotational angle detector.

The present invention will be now described referring to the accompanying drawings. The rotary die casting machine in which the principle of the present invention is incorporated generally comprises a rotary table 14, operation stations and a drive mechanism which are similar to the corresponding components of the prior art rotary die casting machine as described hereinabove. As more clearly shown in FIG. 14, a gear 20 is fixedly secured to the undersurface of the rotary table 14, a pinion 100 is rotatably mounted on the undersurface of the table 14 meshing with the gear 20 and a hydraulic motor 101 having its shaft connected to the pinion is disposed below the table 14 to drive the pinion 100. The arrangement of the gear, pinion and motor is similar to that in the prior art. And as more clearly shown in FIG. 16, a position detecting first transfer gear 151 is mounted on the shaft of the hydraulic motor 101 and a second transfer gear 152 is mounted on the rotary detecting shaft 153 of a rotational angle detector 150 which is secured to the body or the like of the hydraulic motor 101. The second transfer gear 152 meshes with the first transfer gear 151.

Figure 17:
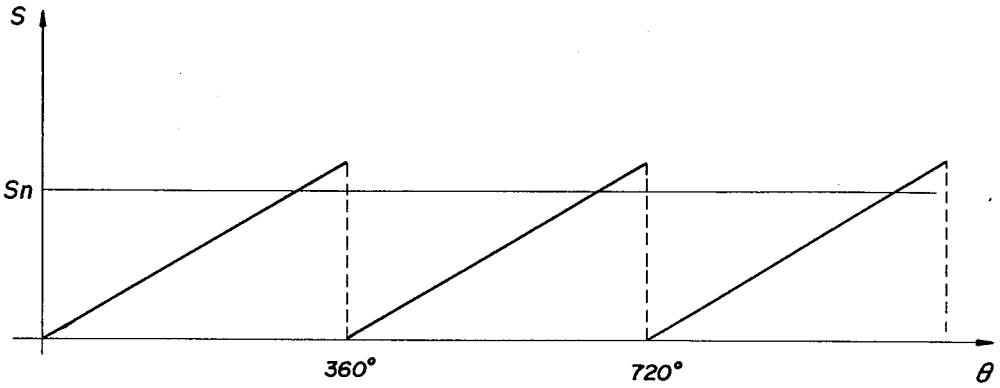
FIG. 17 is a diagram showing the output of the rotational angle detector.
Figure 18:
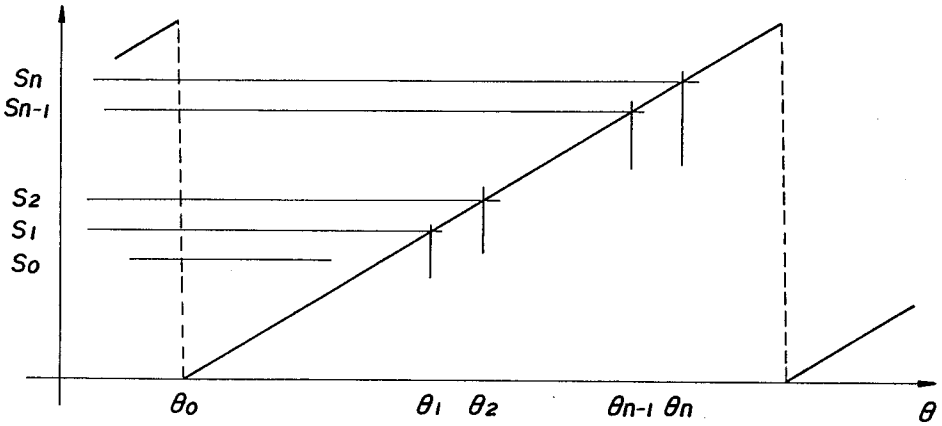
FIG. 18 is a diagram showing the setting of a reference set value as the detecting position.

As more clearly shown in FIGS. 17 and 18, the rotational angle detector 150 is so designed that values of signals from the detector are increased so as to linearly increase the output voltage of the detector corresponding to an increment in rotational angle of the rotary detecting shaft 153. After one complete rotation (360°) of the shaft 153, the output signal value is returned to its original value. And the detector repeats this cycle for each rotation.

The output signal of the rotational angle detector 150 is transmitted to a position determiner 154 which is designed to detect the rotational angle of the rotary table 14 based on the magnitude of the output signal of the rotational angle detector 150 and feed the determined signal to a controller 136.

The controller 136 controls a flow rate control valve 140 based on the determined signal from the position determiner 154 whereby the rotational speed and stop position of the rotary table 14 are controlled in the usual manner.

Figure 1:
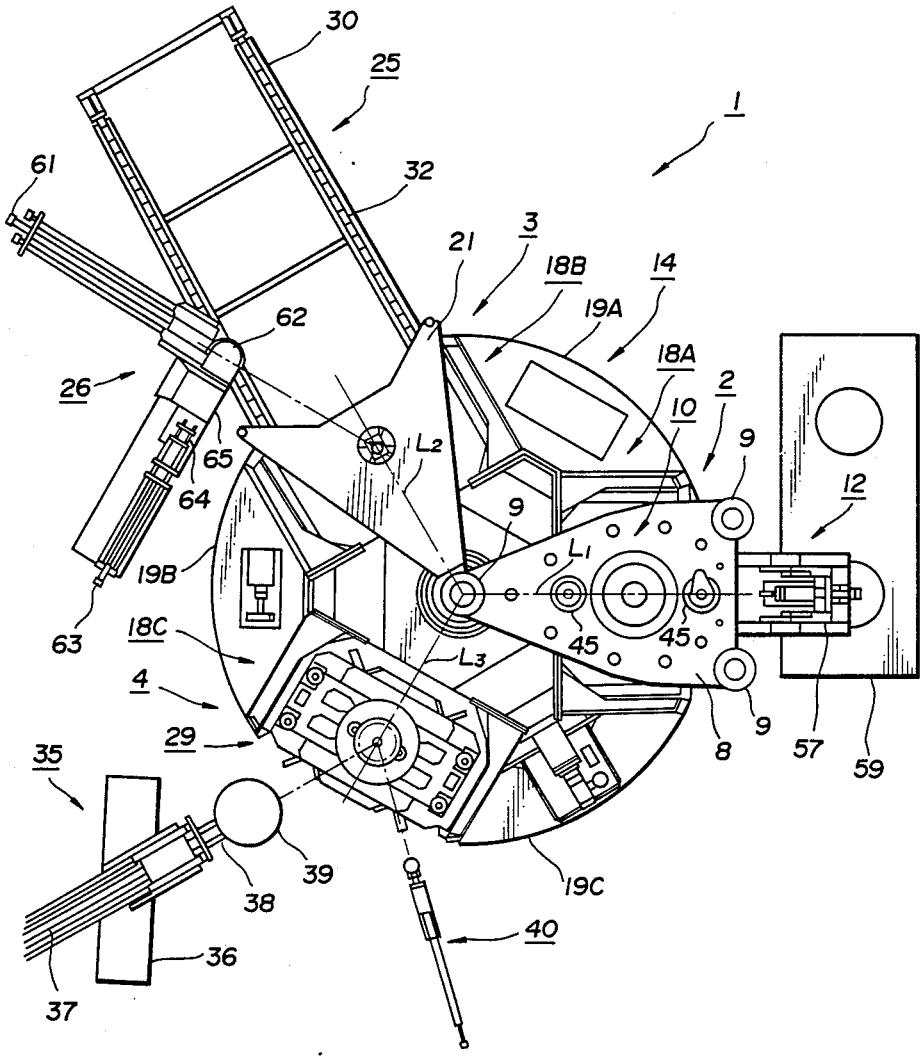
FIG. 1 is a plan view of a first embodiment of the rotary die casting machine constructed in accordance with the principle of the present invention.
Figure 2:
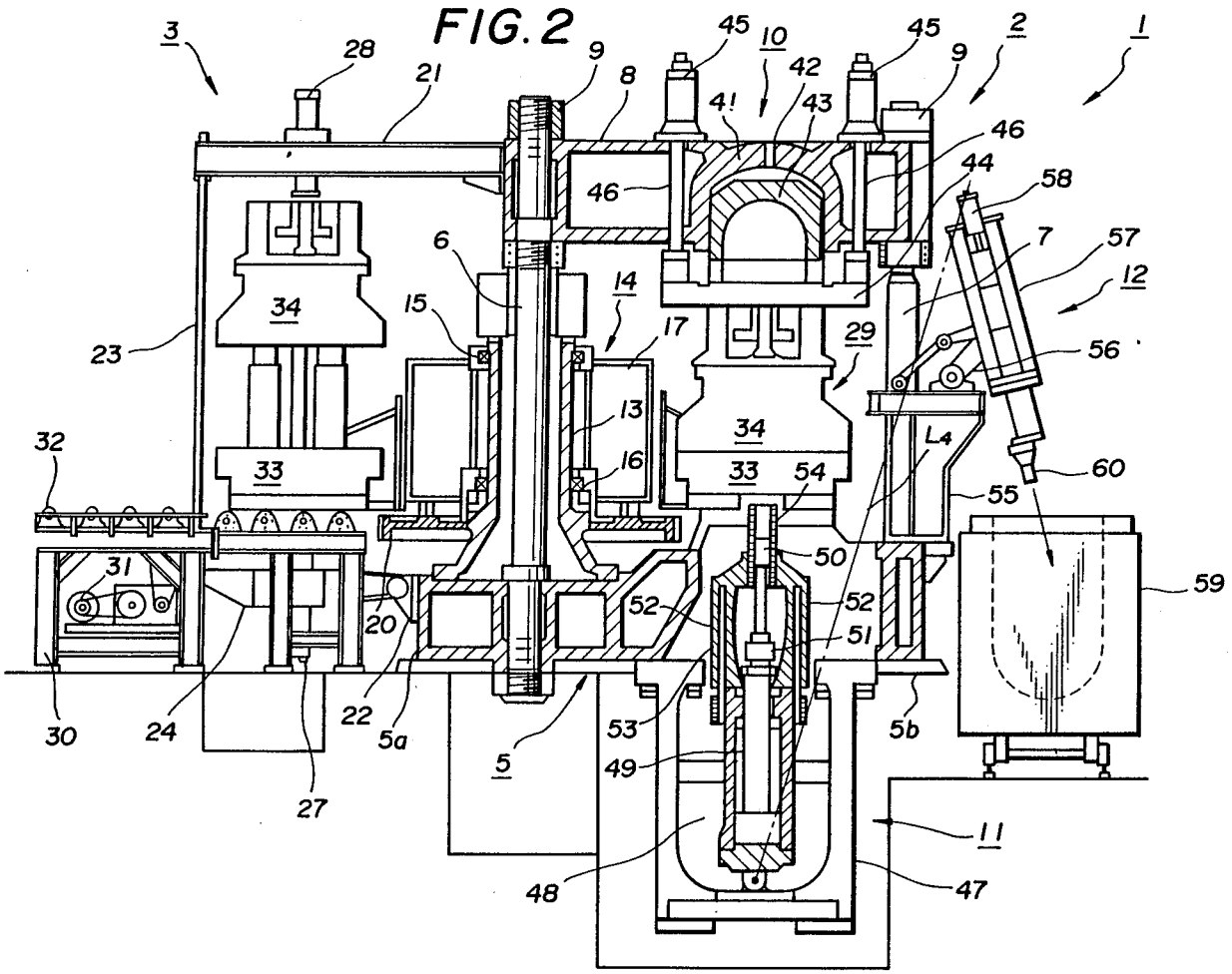
FIG. 2 is a vertical sectional view taken along a substantially vertical center line of the first station in said rotary die casting machine of FIG. 1.
Figure 3:
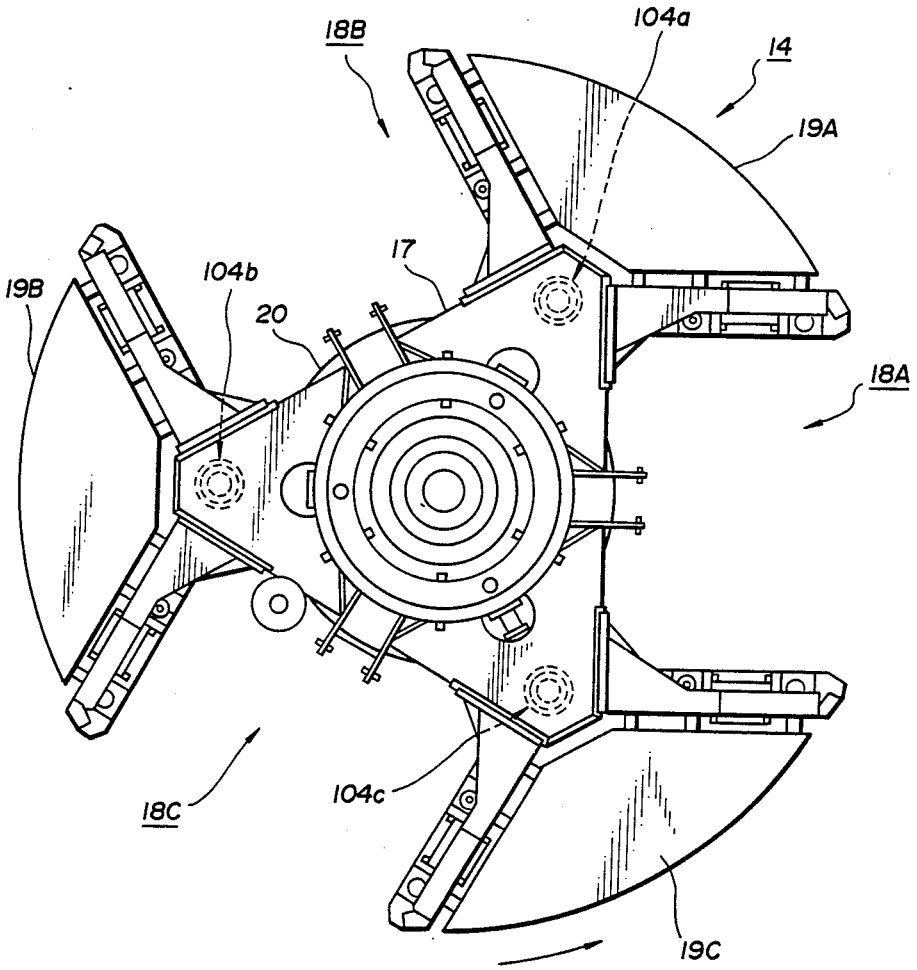
FIG. 3 is a plan view on an enlarged scale of the rotary table in said die casting machine.
Figure 4:
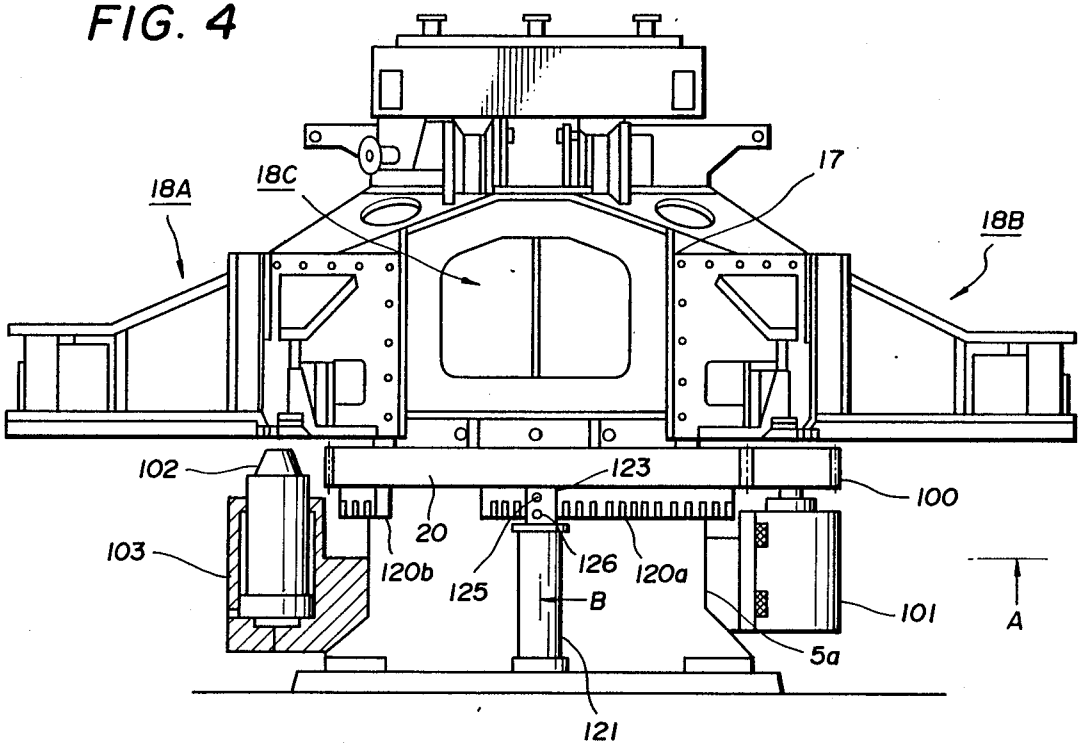
FIG. 4 is a side elevation view of said rotary table shown in FIG. 3.
Figure 5:
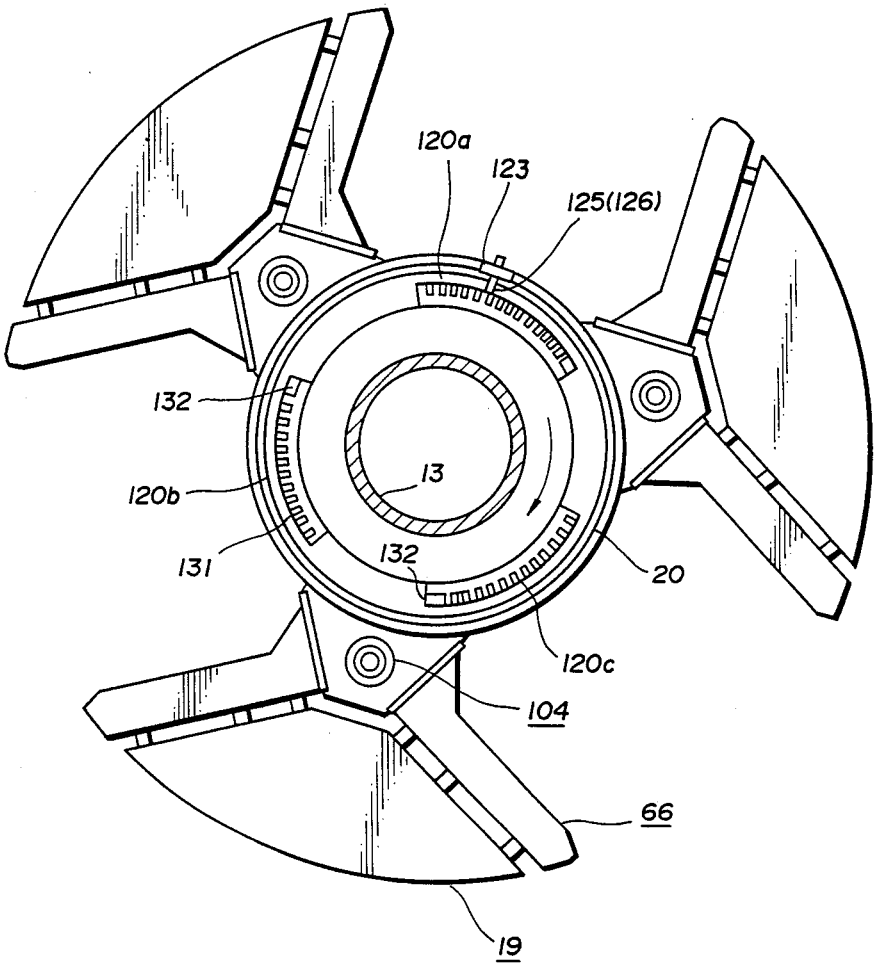
FIG. 5 is a bottom view of said rotary table.
Figure 6:
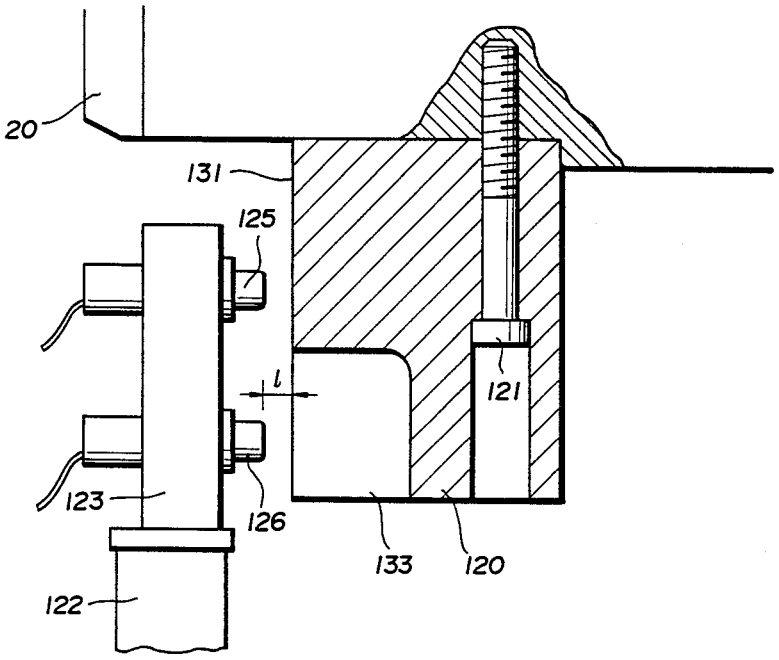
FIG. 6 is a fragmentary view in partial section showing the mounting of a prior art position detecting means.
Figure 7:
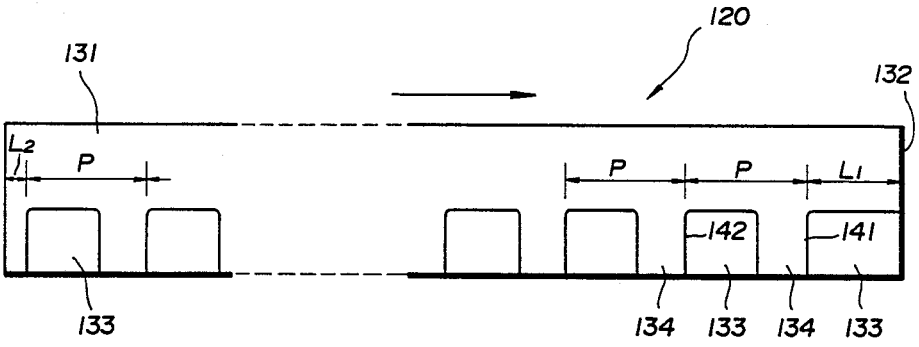
FIG. 7 is a developed view of the cam of said position detecting means of FIG. 6.
Figure 8:
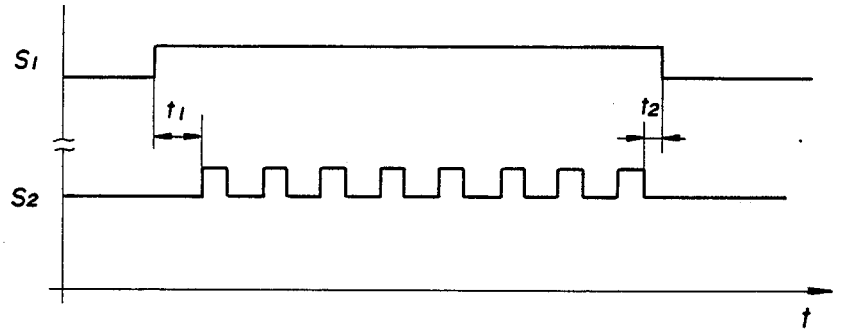
FIG. 8 is a diagram of position pulse signals produced by said position detecting means of FIG. 6.
Figure 9:
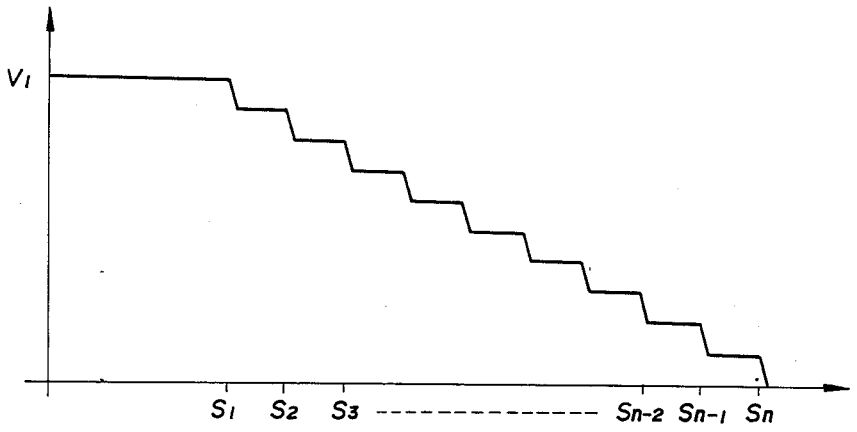
FIG. 9 is a diagram showing variation in valve opening depending upon said position pulse signals.
Figure 10:
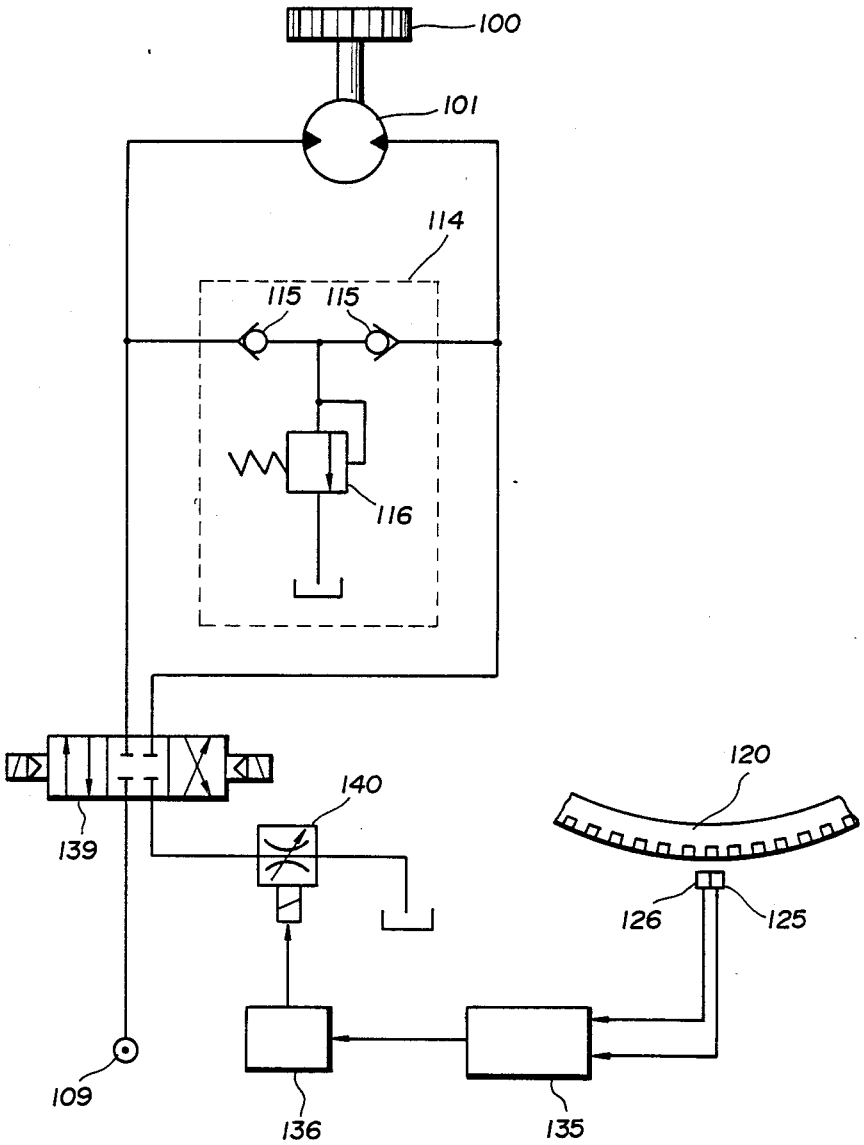
FIG. 10 is a schematic view showing prior art pressurized drive oil and control circuits.
Figure 11:
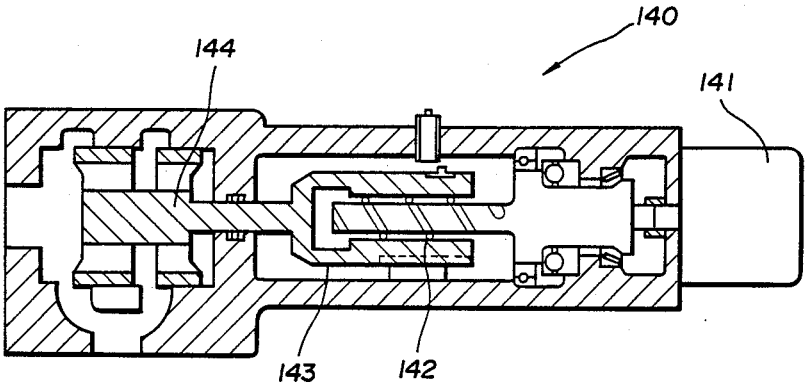
FIG. 11 is a longitudinal sectional view of the flow rate control valve which is applicable to both the prior art die casting machine and the die casting machine of the present invention.

In the embodiment illustrated in FIG. 1, the rotary die casting machine is provided with a first station 2, a second station 3 and a third station 4 equally spaced by 120° and the rotary table 14 is provided with mold opening and closing units which are also equally spaced by 120° and thus, as the rotary table 14 makes one complete revolution, the detecting rotary shaft 153 makes three complete rotations. The ratio of rotation between the rotary table 14 and rotary detecting shaft 153 is so set that as the rotary table 14 makes one complete revolution the rotary detecting shaft 35 makes three rotations by suitably selecting gear ratios between the gear 20, pinion 100 and first and second transfer gears 151, 152 in which combination drive the rotary table 14. Thus, as the rotary table 14 rotates by one third of one complete rotation and the three equally spaced mold opening and closing units 29 at the periphery of the table move between the adjacent operation stations, the rotary detecting shaft 35 makes one complete rotation and the angular position of the rotary table 14 can be detected based on an output signal corresponding to the rotational angle of the rotary detecting shaft 153.

Figure 15:
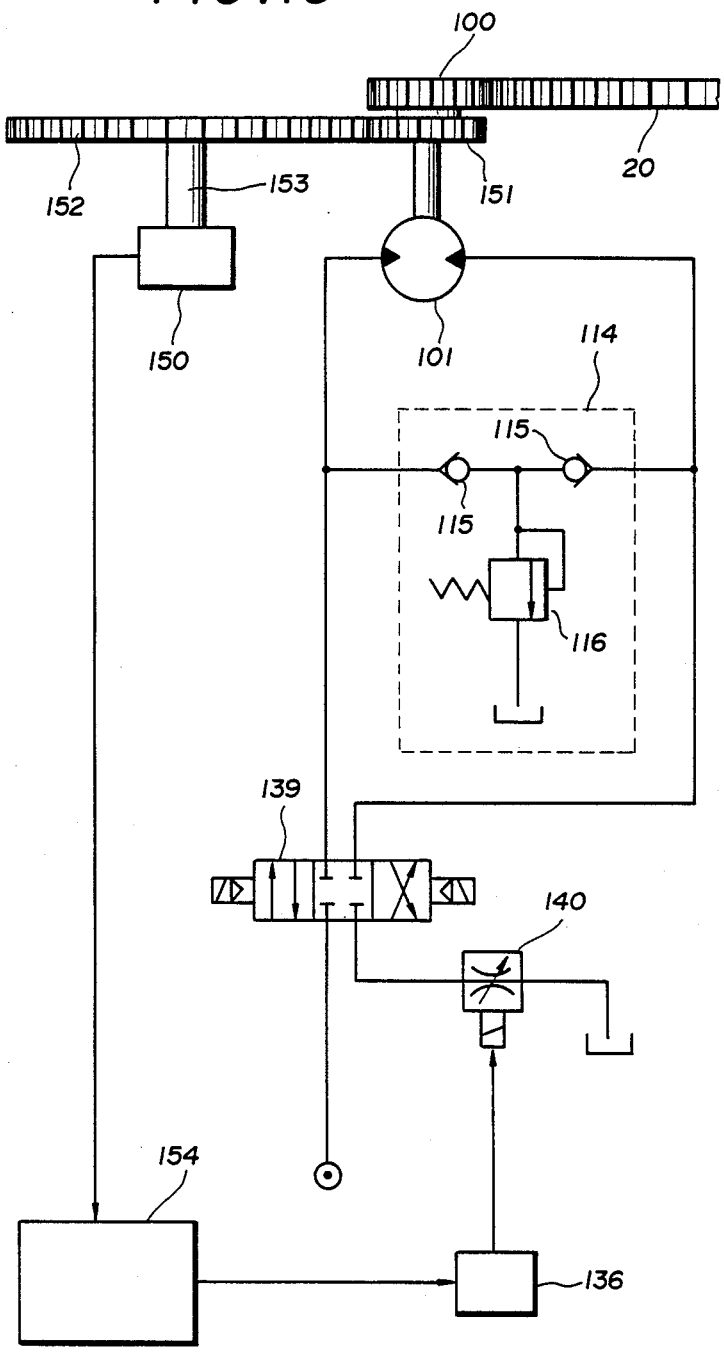
FIG. 15 is a schematic view showing the pressurized oil circuit of the hydraulic motor and the position detecting machanism of the rotary table in the die casting machine of the present invention.

As more clearly shown in FIG. 15, an output signal S from the detector 150 is input to the position determiner 154 in which a 12 bit analog to digital converter circuit is provided whereby when the output of the rotational angle detector 150 is divided by 4096 to be converted into a numeral value, the rotational angle of the rotary table 14 can be detected by the angle of about 0.03°. Thus, the angular position of the rotary table 14 can be detected with a precision several times as high as that obtainable by the prior art minimum pitch limit of about 15 mm in the arrangement wherein the proximity switch 126 detects the recesses formed in the prior art cam 120.

Since the high precision position determiner 154 is embodyed in the first embodiment and as more clearly shown in FIG. 17, the constant value Sn of the output voltage at the rotational angle detector 150 is set as the stop position of the rotary table 14, and optional detection positions Sm (m=0, 1, 2,. . . , n−1) at voltage values lower than the output voltage are set when stop positions of the rotary table are detected it is found that the rotational speed of the rotary table 14 decreases in succession.

Figure 19:
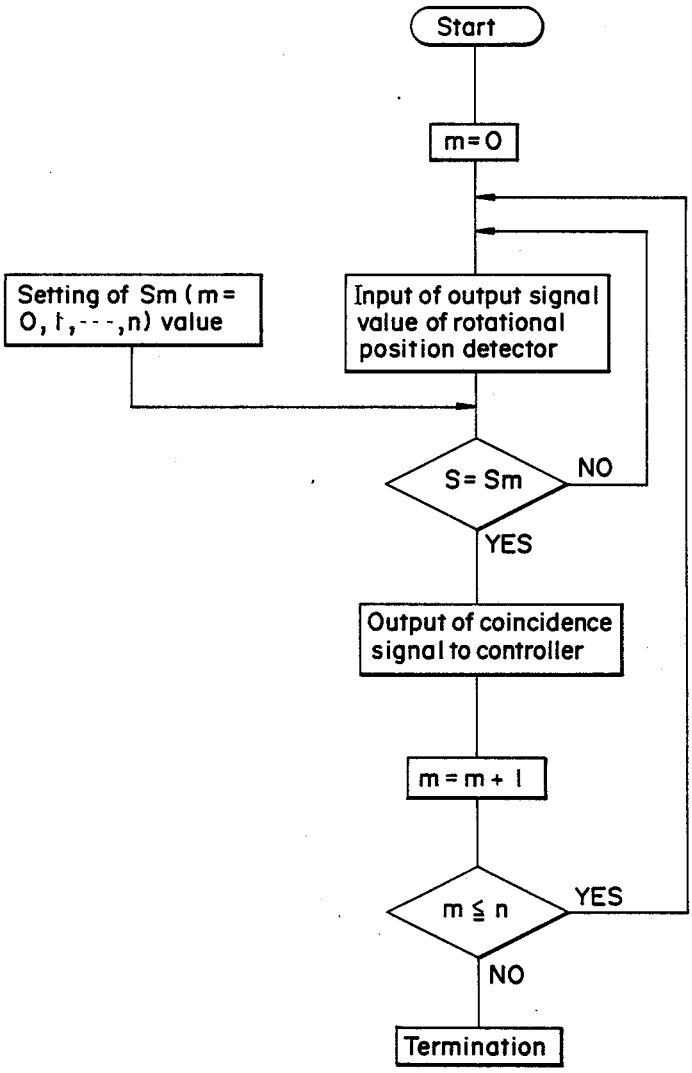
FIG. 19 is a flow chart showing the operation sequence of the position controller.

That is, the value of voltage corresponding to each detection position is previously set in the position determiner 154 as the reference set value and when the position determiner 154 reads the value of the output signal S of the rotational angle detector 150 as shown in FIG. 19 to find that the minimum value So of the output signal corresponds to the value S of the output signal of the rotational angle detector 150, the position determiner 154 outputs a coincidence signal to the controller 136. The position determiner 154 changes the set reference value So to a separately set value S1 and again outputs a coincidence signal when the output signal S coincides with the set reference value S1 and changes the reference set signal S1 to be reference value S2. The operation procedure is repeated. When a signal which coincides with the output signal from the rotational output from the rotational angle detector 150 is output, the position determiner 154 ceases to operate meanwhile the rotary table 14 rotates by one third of its complete rotation to complete the movement of the mold opening and closing units between the adjacent operation stations.

The next rotation of the rotary table 14 is similarly controlled and each time the rotary table rotates by one third of its complete rotation, casting operation can be continuously performed in each operation station.

The rotational angle detector 150 is not limited to a type which outputs its detection value in the form of an analog signal, but may be of the type which outputs a detection signal in the form of a digital signal. In the latter type, the position determiner 154 simply compares the set reference value Sm (m=0, 1, 2, . . .,n) with an output signal from the rotational angle detector 150.

In this way, when the reference set value Sn which corresponds to the stop position for the rotational angle detector 150 is set in a midway in the increment region of the output signal S from the rotational angle detector 150 and more particularly, the latter half of the output signal, the set values So, S1, S2, . . . , Sn−1 for the detection positions are made values increasing gradually on the order, the reference setting values So, S1, S2, . . . Sn−1 corresponding to the detection positions are made less than the reference set value and the rotary table 14 is driven and controlled while detecting and confirming the angular position of the rotary table 14, the detecting position set values So, S1, S2 . . . , Sn−1 are set as values less than that of the reference set value Sn and the rotation of rotary table is controlled while detecting the angular position of the table 14 based on these reference set values whereby even when the rotational angle detector 150 produces an output signal at a value near to Sn at the start of rotation of the rotary table 14, since the reference value set in the position determiner 154 at the start of rotation of the rotary table 14 is the small value So, erroneous operation that the position determiner 154 outputs a determination signal immediately after the start of rotation of the rotary table 14 can be positively prevented.

Such erroneous operation of the position determiner 154 may tremore the rotary table 14 when the correction and setting of the final stop position of the rotary table 14 is performed by the tapered recesses **104*a*-104*c* formed in the undersurface of the table 14 and a knock pin 102 disposed below the table 14 after the rotary table 14 has been decelerated to stop by the rotation and controlling action of the hydraulic motor 101 or the position determiner 154 may again detect the angular position of the rotary table 14 by backlash of a gear train when the rotary table 14 starts to rotate. In the latter case, the position determiner may again output a stop signal to make the start of rotation of the rotary table 14** difficult.

However, according to the embodiment illustrated and described hereinabove, even when the value of the output signal S of the rotational angle determiner 150 coincides with the reference set value Sn corresponding to the stop position of the rotary table 14 immediately after the start of rotation of the table 14, since the reference set value to be compared with the value of the output signal S in the position determiner 154 is replaced by So which is smaller than the value of the stop position, the outputting of the stop signal by the position determiner 154 can be prevented.

In order to prevent the erroneous operation of the position determiner as described hereinabove, it has been generally practiced hithertofore that after the start of rotation of the rotary table, the position detecting operation is halted for a predetermined time period by a timer whereby the outputting of the stop signal immediately after the start of rotation of the rotary table 14 is prevented. However, when the erroneous operation of the position determiner 154 is prevented by the timer, if the rotational speed of the rotary table 14 is varied and more particularly, the rotational speed is abruptly varied, there is a problem in that the rotary table rotates to a predetermined position where deceleration and control are to be performed within the time period set by the timer. In such a case, the time period to be set by the timer has to be changed or altered requiring a troublesome manipulation.

Furthermore, in the embodiment illustrated and described hereinabove, the value increases gradually from the reference set value So to Sn with the reference set value Sn which defines the stop position positioned in a midway of the increment and more particularly, in the last half of the output signal. Furthermore, any point of inflection in the output signal from the rotational angle detector 150 is eliminated. That is, according to the method of the present invention, although the rotational angle of the rotational angle detector is very small, the output signal of the rotational angle detector 150 varies substantially and deceleration and control are effected by detecting, a point other than the point of inflection where precise position detection is difficult due to mechanical error caused by backlash of the gear train. Thus, rotation control with high precision is made possible. Since the reference set value increase in succession, the control program can be easily prepared.

Since the rotational angle detector 150 has a point of inflection at which the output signal S is returned to its original value when the rotational angle is at $2n\pi$, after the start of rotation of the rotary table 14, the rotational angle detector 150 outputs an output signal at a value corresponding to the minimum reference set value S1 at the point of inflection to reduce the amount of variation in liquid flow rate control in the flow rate control valve 140 with a determination signal from the position determiner 154 based on the minimum reference set value S1. The minimum reference set value S1 corresponding to the minimum reference set value So is desirably not employed deceleration control.

However, when the output signal of the rotational angle detector 150 is output in the form of a digital signal, the signal corresponding to the minimum reference set value So can be employed without difficulty because when the output signal from the rotational angle detector 150 is $\theta=2n\pi$, the value of the output is discontinuously varied from the maximum output value 0.

According to the present invention, the disposition of the reference set value S1 to Sn is not limited to an equally spaced disposition, but when the rotational angle detector 150 detects a position in the vicinity of the deceleration initiation position since the rotational speed of the rotary table 14 is high and the rotational speed of the rotary table is low just before the table stops, the space Sm ($m=0, 1, 2, \ldots, n-1$) between the reference set value Sm in the vicinity of the decelaration initiation position is set greater than that between the values in the decelaration initiation position whereby decelaration and stopping are controlled while fine position detection is being effected.

Figure 20:
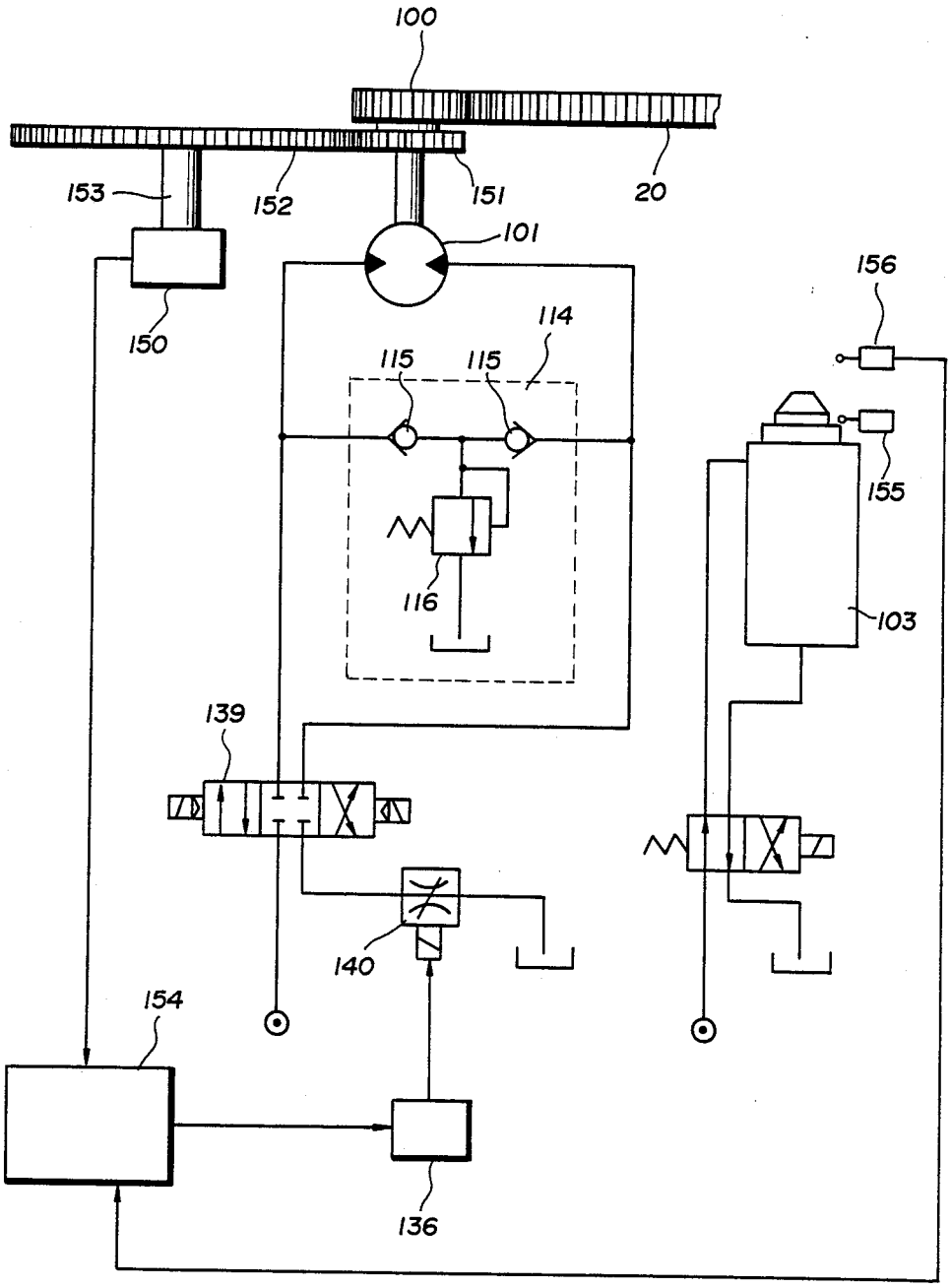
FIG. 20 is a schematic view showing the pressurized oil circuit of the hydraulic motor and the position detecting mechanism of the rotary table in a second embodiment of the die casting machine of the present invention.

In the embodiment illustrated and described hereinabove, the rotary detecting shaft is operatively connected to the drive shaft of the hydraulic motor driving the rotary table through the gear for rotation with the table to detect the angular position of the rotary table using the rotational angle of the rotary detecting shaft and thus, error in measuring caused by distortion of the rotary table which occurs when mold opening and closing units on the table are replaced is minimized. Since the rotational angle detector employed is of a type which continuously outputs signals and increases the output in proportion to increments in rotational angle of the rotational detecting shaft, the angular position of the rotary table can be detected with high precision and since the values of the output signals of the rotational angle detector can be simply increased within a wide range, the position of the rotary table cam be confirmed by the absolute value of the output signal of the rotational angle detector and the rotary table can be positively and precisely controlled and stopped. And in the second embodiment of the present invention shown in FIG. 20, a lower limit switch 155 for detecting the knock pin 102 in its lowered position and an upper limit 156 for detecting the knock pin 102 in its raised position to be inserted into one of the tapered recesses **104*a*–104*c* are provided in the vicinity of a cylinder mechanism 103 to detect the operation of the knock pin 102 so as to control the rotation of the rotary table 14. According to the second embodiment of the present invention, the knock pin 102 is raised to be inserted into one of the recesses 104*a*–104*c* to positively position the rotary table 14 and hold the table in position by the wedging effect of the knock pin 102 and the knock pin 102 in its raised position is detected by the limit switch. As is more clearly shown in FIG. 20, the upper limit switch 156 detects the knock pin 102 in its raised position. As more clearly shown in FIG. 20, a detection signal from the upper limit switch 156 is fed to the position determiner 154. When the detection signal from the upper limit switch 156 is input to the position determiner 154, the position determiner 154 memorizes the value of the output signal S input thereto from the rotational angle detector 150**.

Figure 21:
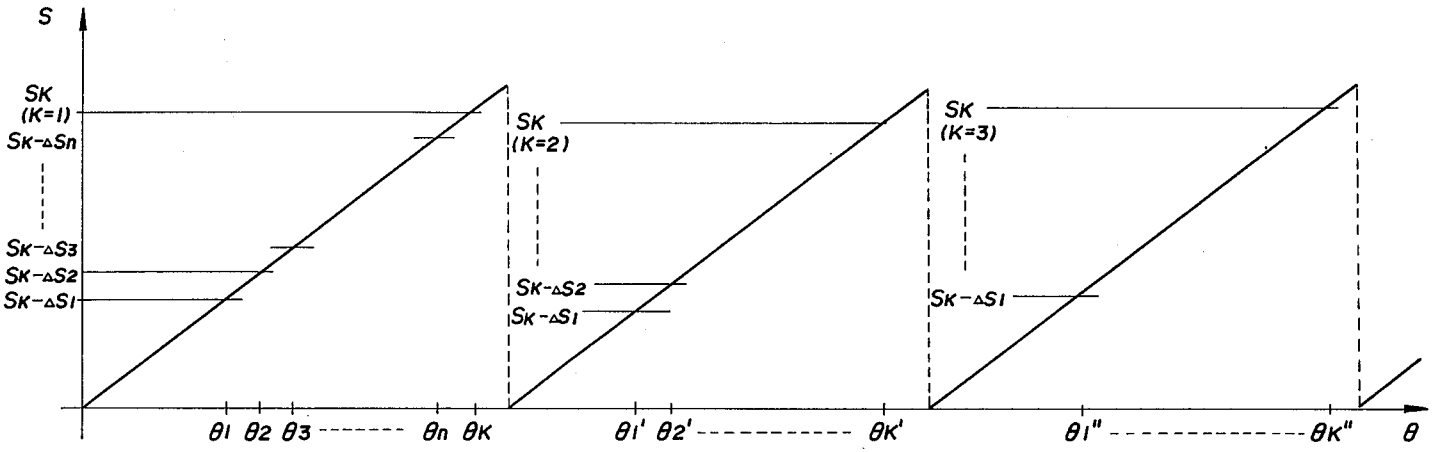
FIG. 21 is a diagram showing the output of the rotational angle detector and a second mode of setting a reference set value in the second embodiment of the invention.

In the second embodiment, the rotational angle detector 150 having high a precision position detecting function as mentioned hereinabove is employed, and when a detection signal from the upper limit switch 156 is input to the position determiner 154 which in turn memorizes the value of the output signal from the rotational angle detector 150 as the value of the stop position (the stop position reference value Sk) and the value So of the position in which the high rotational speed V1 is decelerated and the distance from the decelerating position. In order to calculate the reference set value Sm ($m=1, 2, \ldots n$) by the position determiner 154, the distance ΔS1 between the first decelerating position and stop position, the distance (ΔS2) between the next decelerating position and stop position and so on are previously set in the position determiner 154 whereby the distances (ΔS1, ΔS2, . . . ΔSn) between the successive decelerating positions of the rotary table 14 and successive stop positions of the table are in succession set in the position determiner 154. Further, when the reference set values Sm ($m=1, 2, \ldots n$) of the decelerating positions are calculated based on the memorized stop positions, the stop position reference value Sk is in the last half of the increment in an output signal from the rotational angle detector 150 and the rotational angle detector 150 is so adjusted that the stop position reference value Sk is made greater than the distance ΔS1 for calculating the first decelerating position. Thus, the reference setting values S1, S2, . . . Sn and the value of stop position reference Sk can be made values which linearly increase in succession as shown in FIG. 21.

In the second embodiment, since the three operation stations are provided and the rotary table stops each time the table has rotated by one third of its complete rotation, the number of the stations is represented by J.

And since each time the rotary table 14 has rotated by one third of its complete rotation, the rotary detecting shaft 153 of the rotational angle detector 150 makes one complete rotation, assuming that each stop reference position of the table 14 is as Sk the value Sx common to three stop position values Sk (k=1, 2, . . . J)(J=3) is initially set and the table is started to be driven (FIG. 19).

When the rotary table 14 is driven in this way first the first stop reference value Sk (k=1) is called. The first stop position reference value (k=1) is set at Sx which is the value initially set in the manner as described hereinabove. Sm (m=1) is deducted from the value Sx as the stop position reference value to calculate the reference setting value S1 for decelerating the rotary table 14. The reference set value S1 and the value of an output signal S from the rotational angle detector 150 are compared with each other and when it has been found that the values coincide with each other, a coincidence signal is output to the controller 136 as a discrimination signal. Sm (m=2) is deducted from the stop position reference value Sk (k=1) to calculate the reference set value S2 which is then compared with an output signal S from the rotational angle detector 150 to provide a discrimination signal which is fed to the controller 136. The procedure is repeated. When the determinating signal is input to the controller 136, the controller 136 operates to control the flow rate control valve 140 so that the rotary table 14 is gradually decelerated and the value of the output signal S is compared with the stop position set value Sk (k=1) to stop the rotation of the rotary table 14 whereupon the knock pin 102 is raised to hold the table in its fixed position. The value of an output signal S from the rotational angle detector 150 with the rotary table 14 held in the fixed position is memorized in the position determiner 154 as the stop position reference value Sk (k=1). Each time an operation in each station is completed, the position determiner 154 calls the value of k=2 as the stop position reference value Sk as described hereinabove. Also in the computation based on the stop position reference value Sk (k=2), the first one/third rotation is the initially set value Sx and when the table has rotated by an angular amount, the reference set value Sm (m=1, 2, . . . n) is calculated based on the Sx value as the value of the stop position reference value by the distance ΔSm (m=2) and the table is decelerated while comparing the reference set value Sm and an output signal S from the rotational angle detector 150 with each other. When the knock pin 102 holds the rotary table 14 in its fixed position, the value of the output signal S at this time is memorized as the stop position reference value Sk (k=2) and the next stop position reference value Sk (k=3) is controlled in the same manner. The value Sx corresponding to the value initially set as the stop position reference value Sk (k=1, 2, 3) is referred and replaced with the value at the position actually stopped in each operation station respectively. Each stop position is memorized in the position determiner 154.

Then, in this embodiment, the number of operation station is three, so after controlling has been performed based on the third stop position reference value Sk (k=3), by the computation of 3+1 as the value of k in the stop position reference value Sk, the value of k becomes larger than the number of the operation stations (J) and the rotary table 14 is rotated so as to call the first stop position reference value Sk (k=1).

In the second rotation of the rotary table 14, based on the value memorized in the first rotation as the first stop position reference value Sk (k=1), the table 14 is decelerated to stop in the position where the table was stopped by the knock pin in the first rotation. Since the rotary table 14 is controlled and stopped based on the stop position reference value Sk, when the knock pin 102 is raised, the amount of fine adjustment of the position of the rotary table 14 by the knock pin 102 and the tapered portion of a selected one of the tapered recesses **104*a*–104*c* is very small and the mold opening and closing units 29 are free from any shock which may be otherwise delivered to the units 29 when the table rotates with the knock pin in its raised position. Similarly, in the next operation station, based on the stop position reference value Sk (k=2), the rotary table 14 is decelerated until the table reaches the intended fixed position where the table is held in the fixed position by the knock pin 102. Also in the next operation station, based on the stop position reference value Sk (k=3), the rotary table 14 is decelerated until the table rotates to the intended fixed position in which the table is held in its fixed position by the knock pin 102. Thus, each time the rotary table 14 stops in each stop position, the stop position reference value Sk (k=1, 2, 3) is replaced by a new value and adjustment of the stop position of the rotary table 14 to be conducted can be made very small while the knock pin 102 is being raised and impact which may otherwise occurs in the die casting machine while the knock pin 102** is being raised is reduced.

Figure 22:
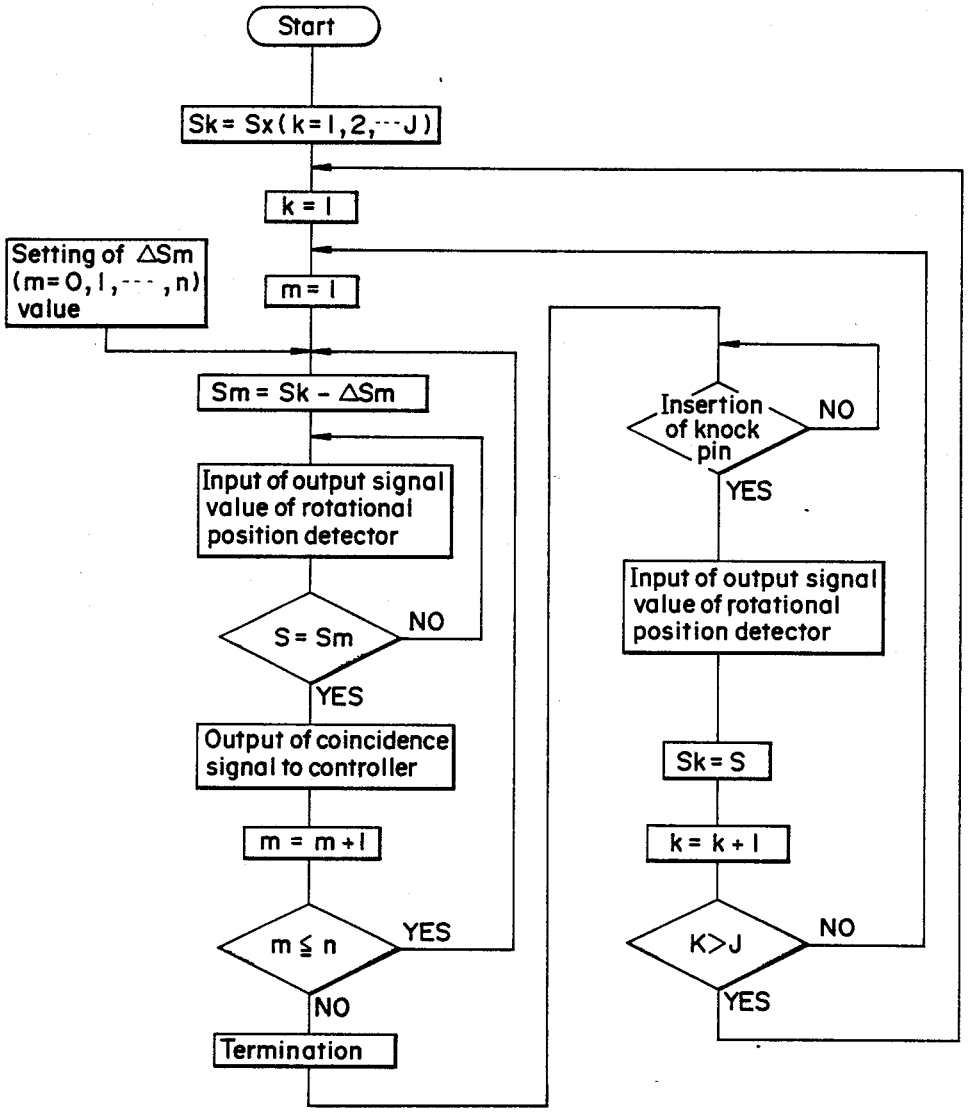
FIG. 22 is a flow chart showing the operation sequence of the second embodiment.

In this way, when the value of a voltage corresponding to each decelerating position is previously set so that the reference set value Sm (m=1, 2,. . . n−1) is calculated based on the stop reference value Sk by the position determiner 154, as more clearly shown FIG. 22, the position determiner 154 converts the value of an output signal S from the rotational angle detector 150 and reads the output signal S from the rotational angle detector 150 after converting the signal into a 12-bit signal. When it has been found that the minimum reference set value S1 and the output signal S of the rotational angle detector 150 coincide with each other, the coincidence signal is input to the controller 136 as a discrimination signal to convert the reference set signal to S2. When it has been found that an output signal, from the rotational angle detector 150 coincides with the reference set value S2, a coincidence signal is again produced to convert the reference set value to S3. The procedure is repeated. When the stop position reference value Sk coincides with an output signal from the rotational angle detector 150 to produce a coincidence signal the position determiner 154 cases its operation. During this inoperative condition, the rotary table makes a one third rotation of its complete revolution to complete an angular movement between adjacent operation stations. The rotary table 14 makes successive one third revolutions in the same manner to continue the casting operation in the successive operation stations.

When the stop position reference value Sk is set in a midway or the latter half region in increment of an output signal S from the rotational angle detector 150, the difference in distance ΔSm (m=1, 2, . . . n) is so set that the reference set values in the decelerating positions values S1, S2, . . . , Sn are set at values increasing in succession less than the stop position reference value Sk and the rotation of the rotary table is controlled while confirming the successive angular positions of the rotary table, and even if the value of an output from the rotational angle detector 150 as the start of revolution of the rotary table 14 is the same as the stop position reference value Sk, since the reference set value of the position determiner 154 is the small S1, any erroneous operation that a discrimination signal for stopping the rotary table 14 is output by the position determiner 154 immediately after the start of rotation of the table can be positively prevented and since the difference in distance ΔSm is common to control of rotation of the rotary table 14 between adjacent stations, a control program can be relatively simply prepared.

The present invention is not limited so that the difference in distance ΔSm (m=1, 2, . . . n) is set so as to make the reference set values S1 to Sn in an equally spaced relationship. Since when a position in the vicinity of the acceleration initiating position is detected, the rotary table 14 rotates at a high speed and the rotational speed of the table is slow just before it stops, the space between adjacent reference set values in vicinity of the deceleration initiating position is set wider than that between adjacent reference values in the vicinity of the stop position, it is preferable that the acceleration and stopping of the rotary table are controlled while performing fine position detecting.

In the second embodiment, the position in which the knock pin holds the rotary table in its stopped condition is the stop position for the rotary table and the reference set values of Sm (m=1, 2, . . . n) of the decelerating positions from the stop position are calculated. The rotary table is decelerated to stop while detecting the angular position of the rotary table based on the calculated reference set value Sm. Thus, according to the method of the second embodiment, it is possible to bring with high precision the stop position to a position near the final stop position to be held by the knock pin. Thus, even when the tapered recesses are not formed in properly 120° spaced relationship because of error in forming the recesses, since each tapered recess and the knock pin can properly stop and hold the rotary table in each stop position, occurrence of impact which may be caused by slight rotation of the rotary table when the knock pin is inserted into each tapered recess, can be prevented. Further, even when drive components such as gears, the hydraulic motor and brackets have worn after prolonged use of the components, since the rotary table is decelerated and stopped while correcting and memorizing the actual preceding stopping and holding position realized by the knock pin as the next stop position, there is also the advantage of high following capability. The mold opening and closing units 29 are desirable be provided on the rotary table 14 in as large a number as possible in order to attain high production efficiency. However, there is the case in which the die casting machine having the rotary table provided with only one or two mold opening and closing units has to be continuously operated in consideration of maintenance.

Figure 12:
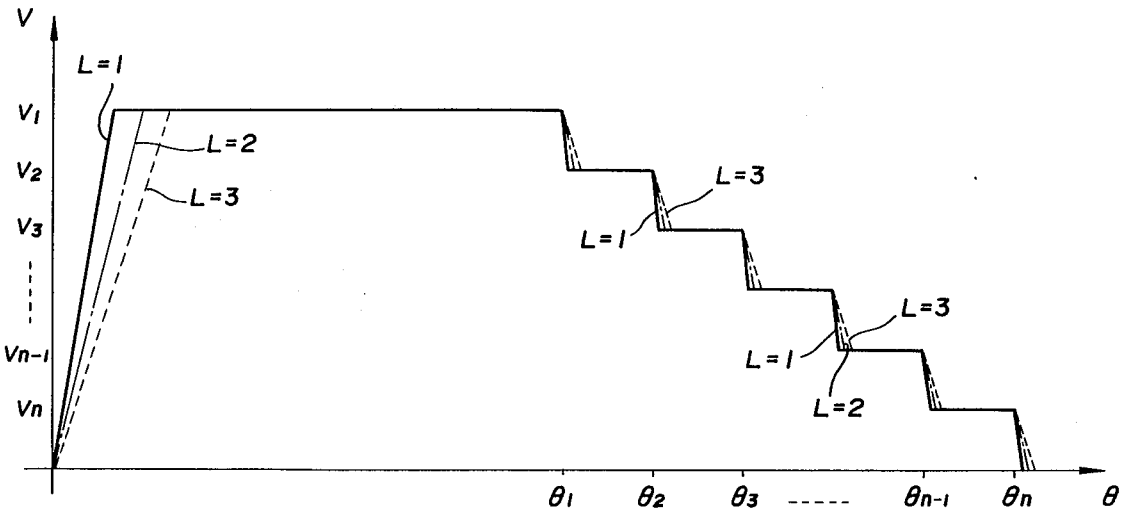
FIGS. 12 and 13 diagrams showing variation in the rotational speed of said rotary table depending upon variation in valve opening.
Figure 13:
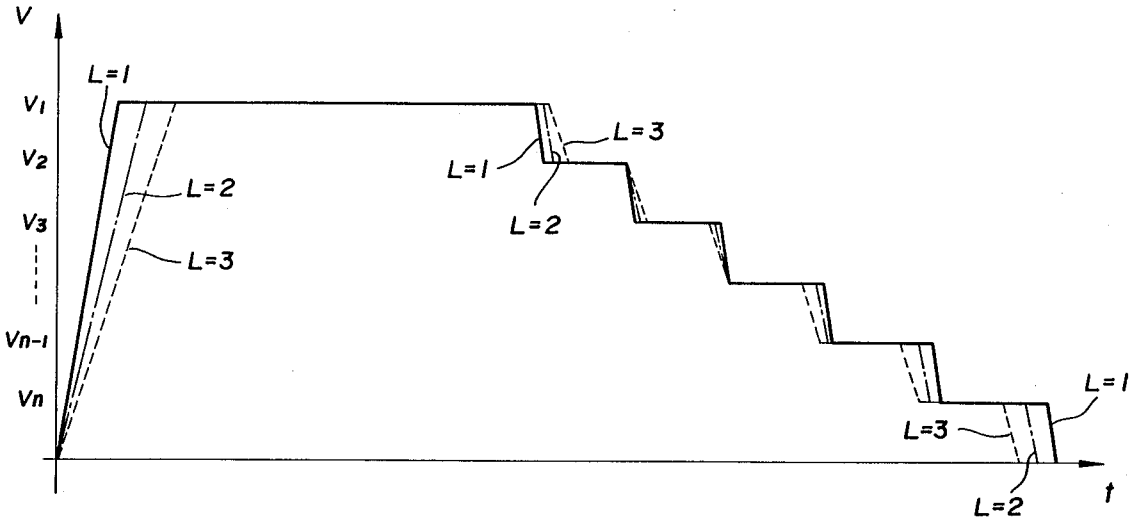

As mentioned hereinabove, the rotary table 14 has an outer diameter of about 6 m and the mold opening and closing units 29 are also large size devices each having a weight of 30 to 50 tons. Thus, when the number of the mold opening - closing units 29 on the rotary table 14 is small and assuming that the same acceleration and braking force is applied to the rotary table, the rotational speed of the rotary table having only one valve opening and closing unit 29 (L=1) varies more abruptly than the rotary table having three valve opening and closing units (L=3) and the time required for the former to reach high rotational speed is shorter than that for the latter (see FIG. 12). However, when braking force is applied to the rotary table 14 in each decelerating position θm (m=1, 2, . . . , n), the table 14 reaches the intended rotational speed more rapidly and varies from one rotational speed to the next speed rapidly in the deceleration region. Thus, a predetermined deceleration is completed in a short time period in each decelerating position θm (m=1, 2, . . . , n) and after deceleration in successively proceeding decelerating positions as the rotary table rotates to the successively following decelerating positions. As a result, the time be elapsed from the initiation of deceleration to stopping of the rotary table as shown in FIG. 13 is long. Thus, the time elapsed from the initiation of acceleration to the stopping of the rotary table in the next stop position is long in reverse and in consequence, the time required for the rotary table to move from one station to the next station is long resulting in further reduction in production efficiency.

When the rotary table has two mold opening and closing units 29 mounted thereon, for example, in order to control deceleration in an optimum way, the decelerating initiation position is set back. With the decelerating initiation position set back, when the rotary table has three mold opening and closing units 29 mounted thereon, for example, the inertia moment becomes large and thus, the degree of deceleration becomes low. As a result, the rotary table stops in a position beyond the predetermined stop position. Even if the difference between the predetermined position and actual stop position is slight, the amount of rotation of the rotary table required for fine adjusting the position of the table when the table is finally positioning the table by inserting the knock pin 102 into a selected one of the tapered recesses **104*a*–104*c*** is increased thereby causing a shock to the machine which may lead to an increase in frequency of trouble with machine.

Figure 23:
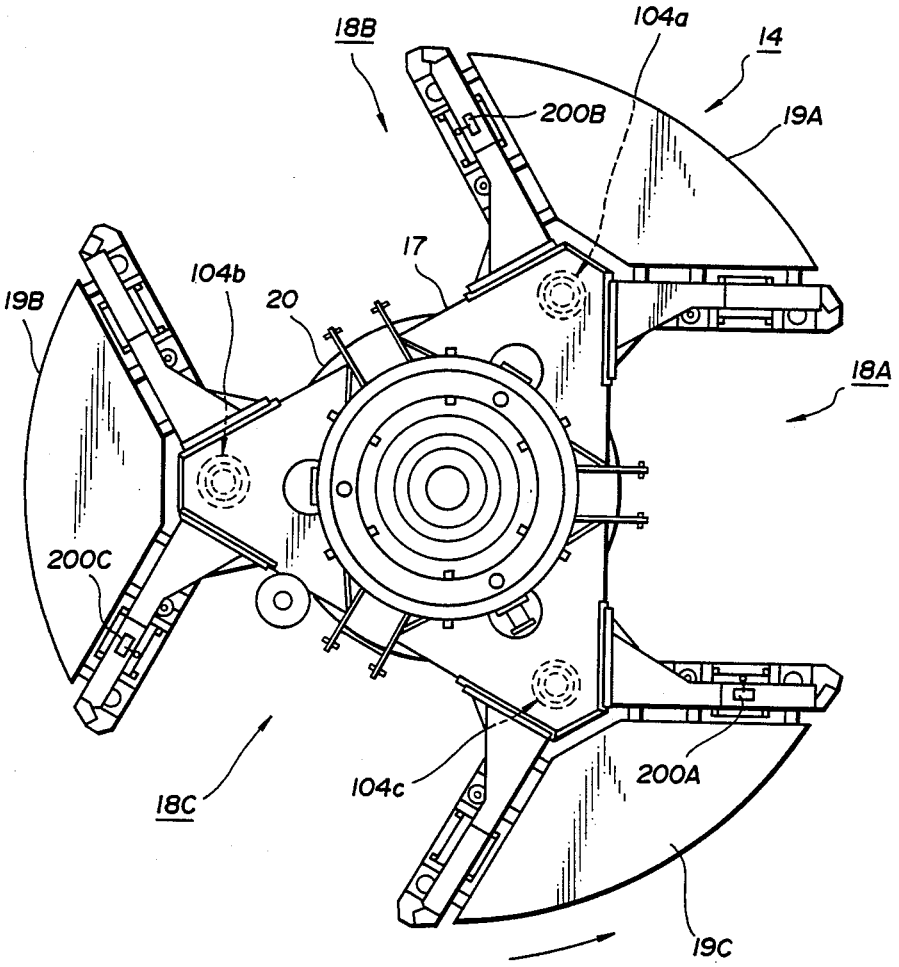
FIGS. 23 and 24 are plan and side elevation views of the third embodiment of the die casting machine according to the present invention, respectively.
Figure 24:
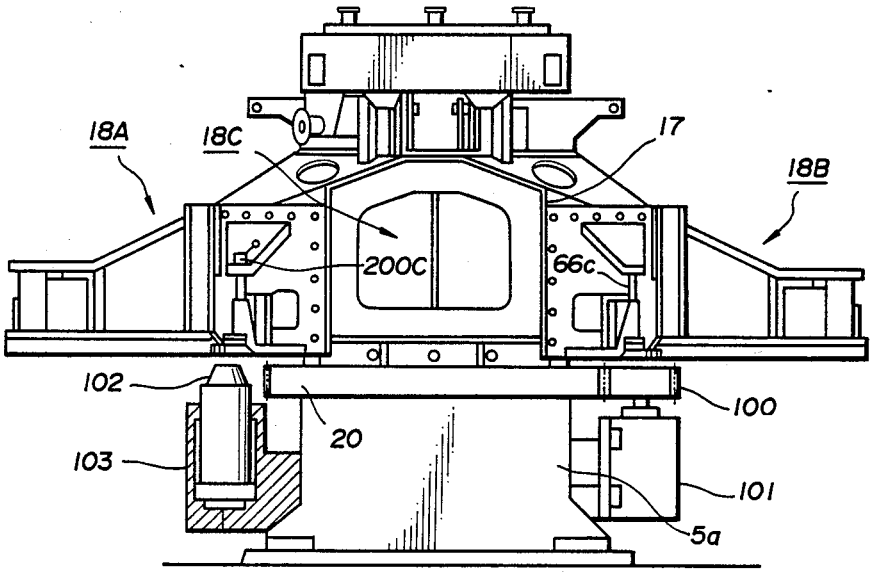
Figure 25:
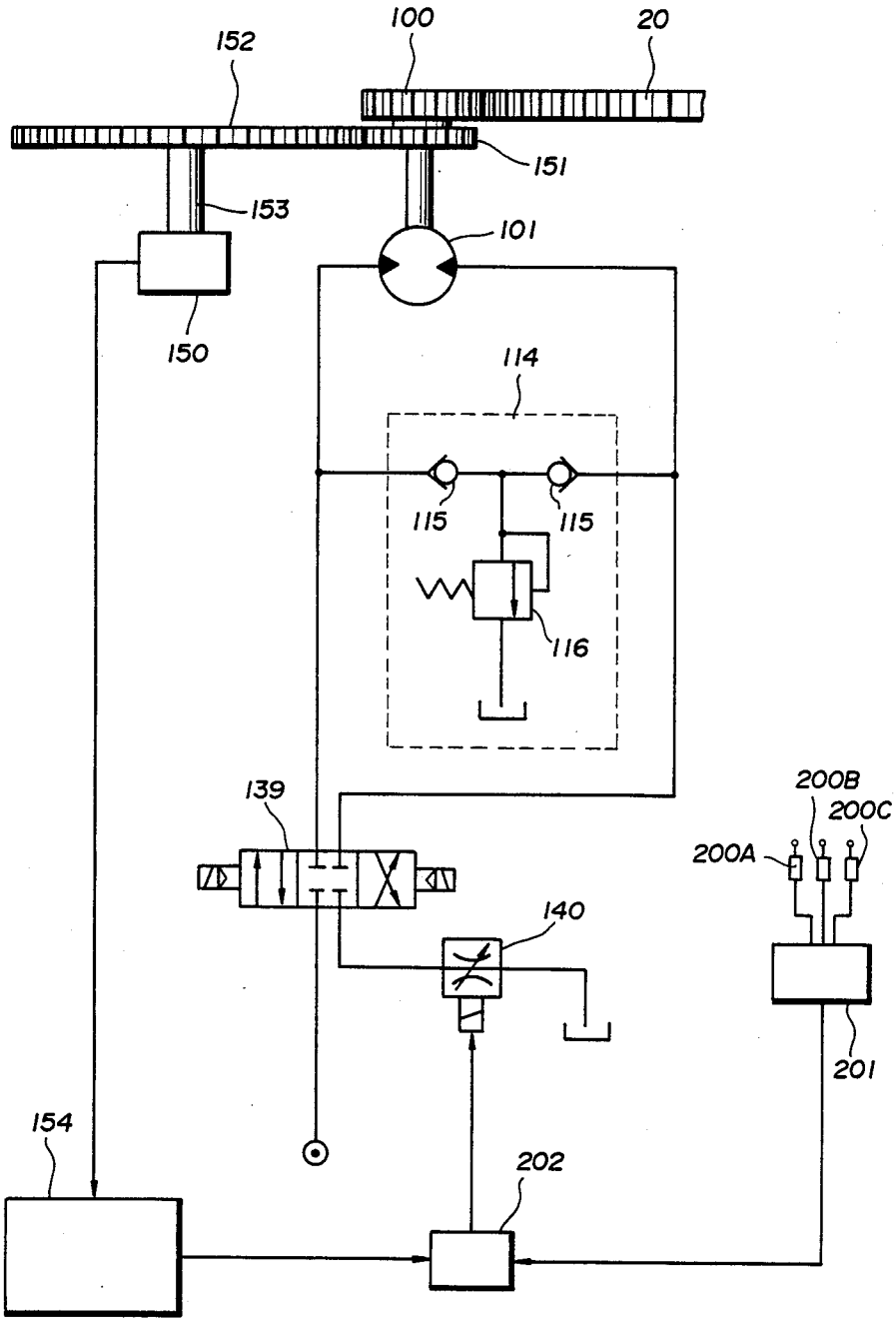
FIG. 25 is a schematic view of the pressurized oil circuit of the hydraulic motor and the position detecting mechanism in the third embodiment of the die casting machine of the present invention.
Figure 26:
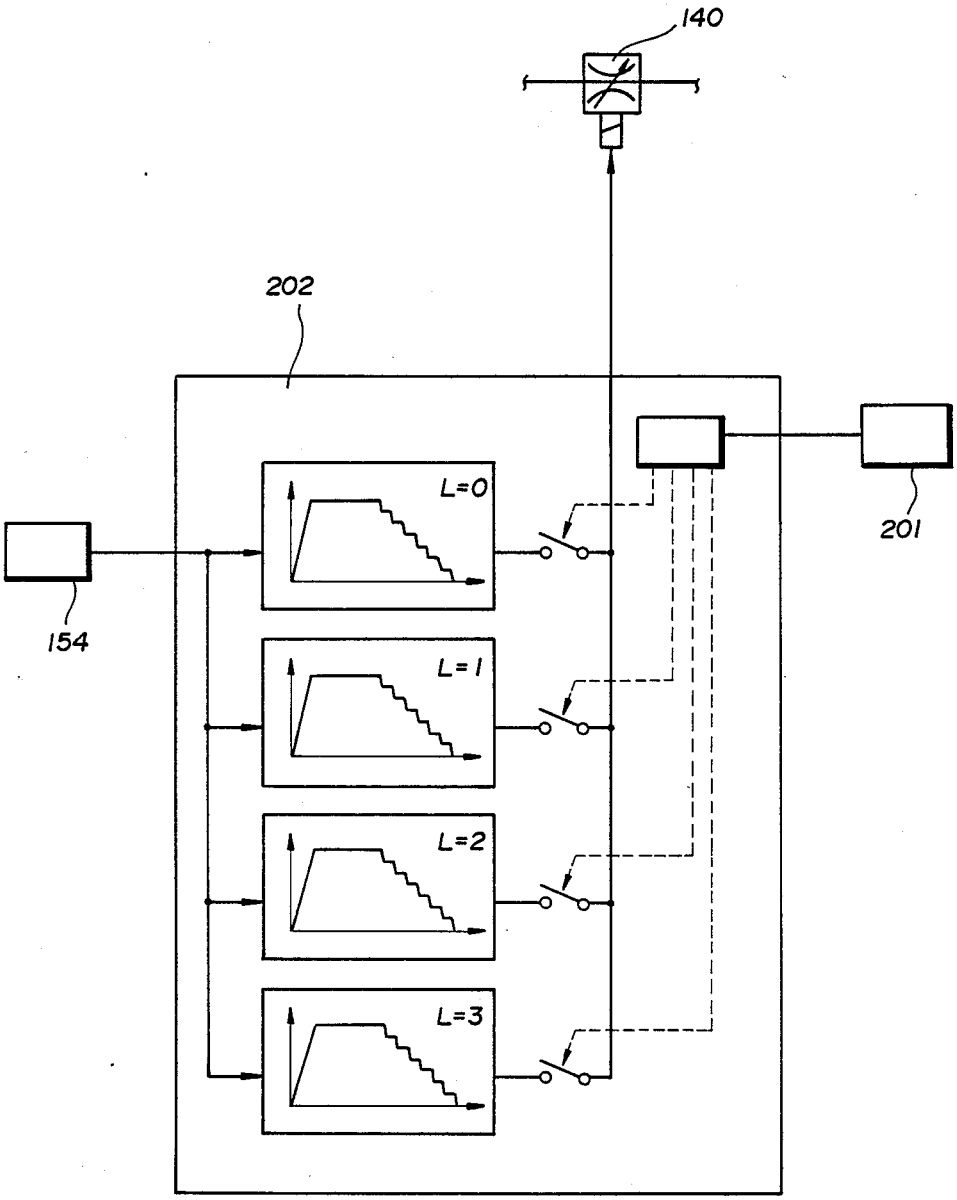
FIG. 26 is a schematic view showing the operation mode of the third embodiment of the die casting machine of the present invention.

The third embodiment of the die casting machine of the present invention is illustrated in FIG. 22 and 23. As shown in these figures, the mold opening and closing unit holders 18A, 18B and 18C on the rotary table 14 are provided with unit detection limit switches 200A, 200B and 200C, respectively. The unit detection limit switches 200A, 200B and 200C are adapted to produce ON signals when the mold opening and closing units 29 are positioned on the mold opening and closing unit holders 18A, 18B and 18C. Thus, the unit detection limit switches 200A, 200B and 200C can detect whether the mold opening and closing units 29 are positioned on the unit holders or not. ON signals from the unit detecting limit switches 200A, 200B and 200C are fed to a detector 201 which is adapted to produce a signal representing the number of the unit detection limit switches 200A, 200B and 200C in operation. The signal output from the detector 201 is fed to the controller 202. In the third embodiment, since the number of the unit detection limit switches is three, the detector 201 produces four types of signals representing the numbers such as 0, 1, 2 and 3, respectively. The number representing a signal from the detector 201 and the determinating signal from the position detector 154 are input to the controller 202 in which a plurality of control programs which have different acceleration and deceleration values corresponding to the number of the mold opening and closing units 29 provided are previously set as shown in FIG. 26. The controller 202 controls the opening and closing speed of the flow rate control 140 by switching the programs depending upon the value of the signal output from the detector 201. In the third embodiment, four different types of control programs corresponding to the values of the signals from detector 201 (0, 1, 2, 3) are previously set in the controller.

In the third embodiment of the invention described hereinabove, since the acceleration and deceleration of the rotary table is controlled by the moment of inertia of the rotary table which varies depending upon the number of the mold opening and closing units provided thereon, rapid braking and stopping of the rotary table can be made to thereby enhance operation efficiency. Further, since the mold opening and closing units can be stopped in a proper stop position by decelerating the rotary table in a short period of time, the present invention provides a rotary die casting machine which gives impact the machine components when the rotary table is held in position by the knock pin.

Figure 27:
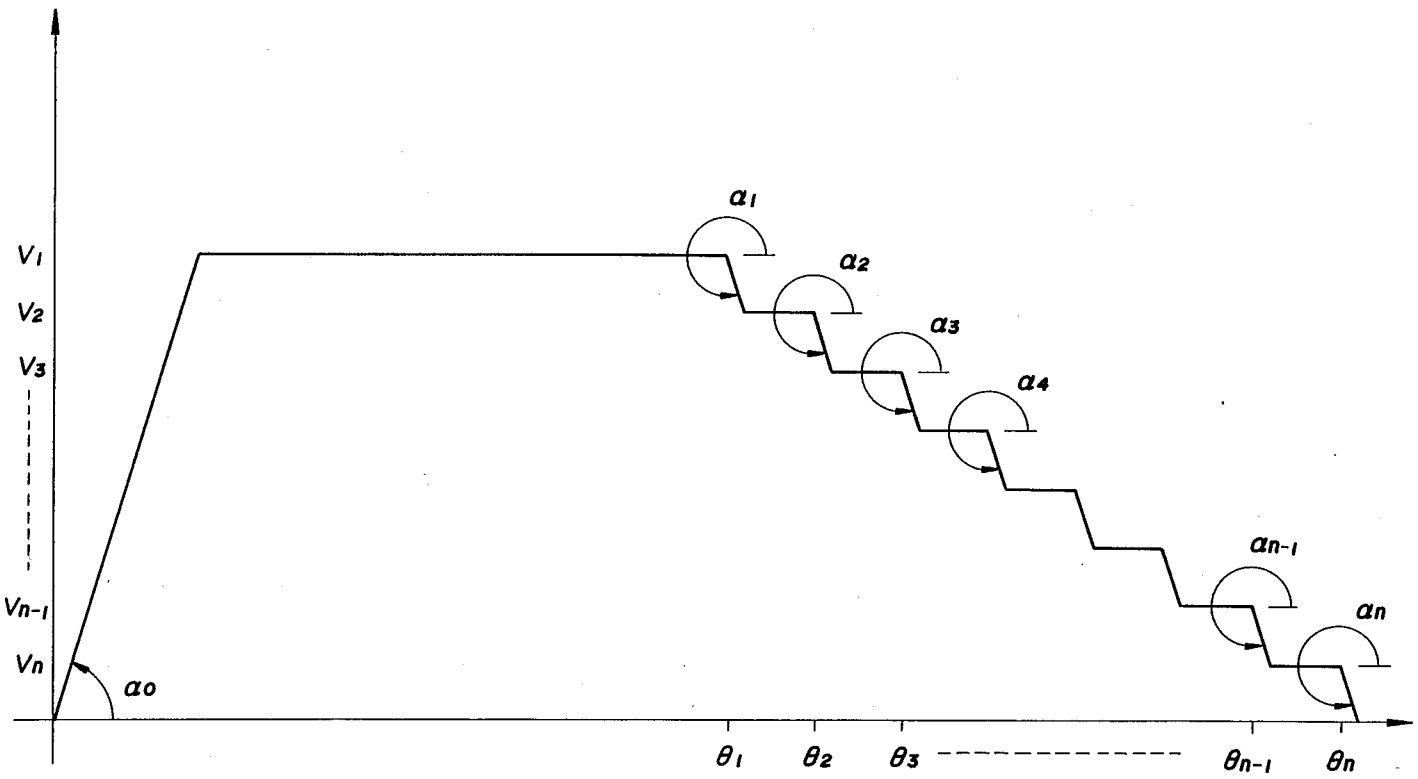
FIG. 27 is a diagram showing acceleration and deceleration characteristics.

The control programs employed in the present invention are so set that when the determination signal from the position determiner 154 is input to the controller 202, the frequency and number of pulses input to the flowrate control valve 140 from the controller 202 can be optionally set each time each determinating signal is input to the controller 202 and the frequency of the pulses determines the opening and closing speed of the flow rate control valve 140. Thus, as shown in FIG. 27, control programs can be so prepared that the programs can individually set the speed and magnitude in variations in speed such as acceleration speed $\alpha 0$, maximum speed V1, initial acceleration $\alpha 1$, set speed V2 after initial deceleration, second deceleration $\alpha 2$ and set speed V3 after second deceleration. Thus, the programs have enhanced flexibility and can simply set optimum acceleration and deceleration in conformity with the conditions of the rotary table 14.

Thus, when the decelerating position and spaces between decelerating positions of the rotary table 14 are set, control programs suitable for the number of the mold opening and closing units 29 on the rotary table 14, that is, the inertia moment of the rotary table 14, the capacity of the hydraulic motor 101 and the conditions of the other bearings. Further, when a plurality of programs suitable for different accelerations and decelerations and programs to be used for different numbers of the units 29 are automatically switched, the rotary table 14 can be always rapidly and precisely stopped in a predetermined stop position.

While the present invention has been particularly shown and described with reference to the preferred embodiments thereof, it will be understood by those skilled in the art that various changes in form and details may be made therein without departing from the spirit and scope of the invention.

What is claimed is:

1. Method for driving and controlling a rotary table of a die casting machine including the steps for:

providing a plurality of mold opening and closing units on an outer periphery of the rotary table, each of said units having a pair of metal molds;

intermittently rotating and stopping the rotary table to bring the mold opening and closing units in their stopped position into alignment with each operation station of said die casting machine to perform a predetermined operation at each operation station to each mold opening and closing unit;

rotating said rotary table with a motor and controlling the rotation and stopping of the motor with a controller;

providing a rotary detecting shaft adapted to rotate in response to the rotation of the rotary table to detect the rotational angle of said rotary table;

producing output signal values with a rotational angle detector values of which continuously increase while said rotary detecting shaft makes one complete rotation and the values of which also correspond to the rotational angles of said rotary detecting shaft;

detecting a negative acceleration commencement position of said rotary table on the basis of the stopped position of the rotary table, with said output signal values;

commencing the negative acceleration in the rotary speed of said rotary table with said controller in response to said output signal value detected by the above step;

detecting the rotational position of the rotary table rotating with negative acceleration at each predetermined angle with output signal values of which the values continuously increase from the output signal value showing said negative acceleration commencement position; and stopping said rotary table at the stopped position with said controller when the output signal values take predetermined values corresponding to said stopped position for performing said predetermined operation.

2. The method for driving and controlling a rotary table as set forth in claim 1, in which the plurality of mold opening and closing units and the operation stations are equally spaced, respectively selecting a gear ratio which is so set that while the rotary shaft is making one complete rotation, the rotary table rotates between adjacent operation stations.

3. The method for driving and controlling a rotary table as set forth in claim 1, in which as the values of output signals from the rotational angle detector increase, rotational speed of the rotary table is decelerated and the stop position of the rotary table is positioned in the last half of each output signal of the rotational angle detector.

4. The method for driving and controlling a rotary table as set forth in claim 2, comprising the steps of calculating the decelerating position based on the previous detected stop position, comparing detected values of the rotary table as the table rotates and the value of the calculated decelerating position to brake and stop the table, detecting the stop position again to use the detected stop position as the next stop position.

5. The method for driving and controlling a rotary table as set forth in claim 4, in which when the rotary table is stopped so as to bring the mold opening and closing units to the positions of a plurality of operation stations, the stopping of the rotary table in the operation stations is effected by using the preceeding stop position as the base.

6. The method for driving and controlling a rotary table as set forth in claim 1, comprising the steps of detecting the number of mold opening and closing units mounted on the rotary table, setting previously different acceleration and deceleration values of the rotary table corresponding to the number of the mold opening and closing units and switching to different acceleration and deceleration values based on the detected number of the mold opening and closing units.

* * * * *